US010971081B2

(12) United States Patent
Kang et al.

(10) Patent No.: US 10,971,081 B2
(45) Date of Patent: Apr. 6, 2021

(54) DRIVER CIRCUIT, LIGHT-EMITTING DISPLAY DEVICE, AND DRIVING METHOD

(71) Applicant: LG Display Co., Ltd., Seoul (KR)

(72) Inventors: MinHyung Kang, Paju-si (KR); Koichi Miwa, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/531,924

(22) Filed: Aug. 5, 2019

(65) Prior Publication Data

US 2020/0043421 A1 Feb. 6, 2020

(30) Foreign Application Priority Data

Aug. 6, 2018 (KR) ..... 10-2018-0091237

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0413* (2013.01); *G09G 2300/0426* (2013.01); *G09G 2300/0439* (2013.01)

(58) Field of Classification Search
CPC ... G09G 3/3275; G09G 3/3283; G09G 3/3291
See application file for complete search history.

(56) References Cited

U.S. PATENT DOCUMENTS

| | | | | |
|---|---|---|---|---|
| 2015/0161940 | A1* | 6/2015 | Woo | G09G 3/003 345/58 |
| 2016/0078813 | A1 | 3/2016 | Mizukoshi | |
| 2016/0086544 | A1 | 3/2016 | Park et al. | |
| 2017/0243546 | A1* | 8/2017 | Ono | G09G 3/3266 |
| 2017/0294166 | A1* | 10/2017 | Kim | G11C 19/28 |
| 2018/0033373 | A1 | 2/2018 | Hong et al. | |
| 2018/0061293 | A1 | 3/2018 | Park | |
| 2018/0061296 | A1 | 3/2018 | Shim | |
| 2018/0144705 | A1 | 5/2018 | Lee et al. | |
| 2018/0151661 | A1 | 5/2018 | Oh et al. | |

FOREIGN PATENT DOCUMENTS

| | | | |
|---|---|---|---|
| CN | 104637443 | A | 5/2015 |
| EP | 2 747 066 | A1 | 6/2014 |
| EP | 2 881 932 | A2 | 6/2015 |
| JP | 2017-120409 | A | 7/2017 |
| JP | 2018-092167 | A | 6/2018 |
| KR | 10-2017-0027292 | A | 3/2017 |
| KR | 10-2017-0053987 | A | 5/2017 |
| TW | 201822179 | A | 6/2018 |
| TW | 201824238 | A | 7/2018 |

* cited by examiner

*Primary Examiner* — Kevin M Nguyen
(74) *Attorney, Agent, or Firm* — Seed IP Law Group LLP

(57) ABSTRACT

The present disclosure describes a driver circuit, a light-emitting display device, and a driving method. Even in the case that other video control driving, e.g., fake data insertion driving, is performed during sensing driving, the sensing is not influenced by the other video control driving, e.g., fake data insertion driving. Sensing errors are prevented, and image quality is improved.

20 Claims, 21 Drawing Sheets

Case 1

RT_TRACK
RT_INIT
FDI
RT_SAM
SCAN
SENSE
SPRE
(a)
SAM
DL
H
L
H
RVL
Vdata_SEN
VpreS
DL-RVL Coupling
Sensing Error
RT_TRACK
RT_INIT
FDI
RT_SAM
SCAN
SENSE
SPRE
(b)
SAM
DL
L
L
L
RVL
Vdata_SEN
VpreS Case 2

RT_TRACK
RT_INIT
FDI
RT_SAM
SCAN
SENSE
SPRE
(a)
SAM
DL
H L H
RVL
Vdata_SEN
VpreS
DL-RVL Coupling
Sensing Error
RT_TRACK
RT_INIT
FDI
RT_SAM
SCAN
SENSE
SPRE
(b)
SAM
DL
L L L
RVL
Vdata_SEN
VpreS

Case 3

DRIVER CIRCUIT, LIGHT-EMITTING DISPLAY DEVICE, AND DRIVING METHOD

CROSS REFERENCE TO RELATED APPLICATION

This application claims priority to Korean Patent Application No. 10-2018-0091237, filed on Aug. 6, 2018, which is hereby incorporated by reference for all purposes as if fully set forth herein.

BACKGROUND

Technical Field

The present disclosure embodiments relates to a driver circuit, a light-emitting display device, and a driving method.

Description of the Related Art

Organic light-emitting display devices that have recently come into prominence have advantageous features, such as a rapid response rate, high luminous efficiency, high luminance, and a wide viewing angle, since organic light-emitting diodes (OLEDs) able to emit light themselves are used therein.

In such a light-emitting display device, a plurality of subpixels respectively including a light-emitting diode and a driver transistor driving the light-emitting diode are arrayed in the form of a matrix, and brightness levels of subpixels, among the plurality of subpixels, selected by a scanning signal, are controlled depending on grayscales of data.

In the light-emitting display device, a light-emitting diode (LED) and a driving transistor driving the same are disposed in each of subpixels defined in a display panel. Characteristics deviations among the driving transistors of the subpixels may occur, due to changes in characteristics (e.g., threshold voltage or electron mobility) of the driving transistors in the subpixels or different driving times of the subpixels. Consequently, the subpixels may have different levels of luminance (non-uniform luminance), thereby degrading image quality.

BRIEF SUMMARY

The present disclosure provides a sensing and compensation technology for detecting characteristics deviations among driving transistors and compensating for the deviations thereof to reduce or minimize different levels of luminance among subpixels. The present disclosure further reduces sensing errors that may occur based on unexpected reasons which causes abnormal images, artifacts, glitches in the display panel.

One aspect of the present disclosure provide a driver circuit, a light-emitting display device, and a driving method able to accurately detect luminance deviations among subpixels without a sensing error, thereby accurately compensate for the luminance deviations among the subpixels.

Also provided are a driver circuit, a light-emitting display device, and a driving method able to accurately perform a sensing operation in real time during video driving.

Also provided are a driver circuit, a light-emitting display device, and a driving method able to prevent a sensing error from being caused by other video control driving, even in the case that other video control driving for the improvement of image quality is performed during the sensing operation, so that an accurate sensing result can be obtained.

Also provided are a driver circuit, a light-emitting display device, and a driving method able to prevent a sensing error from being caused by the fake image driving, even in the case that fake image driving (e.g., black data insertion driving) corresponding to other video control driving for the improvement of image quality is performed during the sensing operation, so that an accurate sensing result can be obtained.

Also provided are a driver circuit, a light-emitting display device, and a driving method able to prevent the reference voltage line used as a sensing line from voltage changes caused by the fake image driving (e.g., black data insertion driving), even in the case that the fake image driving (e.g., black data insertion driving) is performed during the sensing operation, so that an accurate sensing result can be obtained.

According to another aspect of the present disclosure, one or more embodiments may provide a light-emitting display device including: a display panel in which a plurality of data lines and a plurality of gate lines are disposed, a plurality of subpixels defined by the plurality of data lines and the plurality of gate lines are arrayed, and a plurality of reference voltage lines are disposed; a data driver circuit driving the plurality of data lines; and a gate driver circuit driving the plurality of gate lines.

In the light-emitting display device, a sensing period for a sensing target subpixel selected from among the plurality of subpixels may include: a first period in which a sensing data voltage is supplied to the sensing target subpixel through a first data line among the plurality of data lines, and a sensing reference voltage is supplied to the sensing target subpixel through a first reference voltage line among the plurality of reference voltage lines; a second period in which a voltage of the first reference voltage line is increased; and a third period in which the voltage of the first reference voltage line is detected when a predetermined time has passed after a start of the second period.

During the second period and the third period, a data line, among the plurality of data lines, crossing the first reference voltage line or a connecting line electrically connected to the first reference voltage line, may be maintained at a voltage different from the sensing data voltage.

During the second period and the third period, the data line crossing the first reference voltage line or the connecting line may be maintained at a voltage lower than the sensing data voltage.

During the second period and the third period, the data line crossing the first reference voltage line or the connecting line may be maintained at a fake data voltage different from the sensing data voltage and different from a data voltage generated from real video frame data.

For example, the fake data voltage may be a black data voltage.

A subpixel, among the plurality of subpixels, to which the fake data voltage is supplied, may be different from the sensing target subpixel, and may be located on a different line from the sensing target subpixel. The subpixel to which the fake data voltage is supplied and the sensing target subpixel may be commonly connected to the first reference voltage line.

The data line crossing the first reference voltage line or the connecting line may be the same as the first data line.

In some cases, the data line crossing the first reference voltage line or the connecting line may be different from the first data line.

The sensing target subpixel may include: an organic light-emitting diode; a driving transistor driving the organic light-emitting diode; a scanning transistor controlled by a scanning signal, and electrically connected between a first node of the driving transistor and the first data line; a sensing transistor controlled by a sensing signal, and electrically connected between a second node of the driving transistor and the first reference voltage line; and a storage capacitor electrically connected between the first node and the second node of the driving transistor.

The first reference voltage line may be electrically connected to one or more subpixels other than the sensing target subpixel.

The light-emitting display device may further include: a sensing reference switch controlling a connection between a sensing reference voltage supply node and the first reference voltage line; an analog-to-digital converter sensing a voltage of the first reference voltage line; and a sampling switch controlling a connection between the first reference voltage line and the analog-to-digital converter.

During the first period, the scanning signal may be a turn-on level voltage, the sensing signal may be a turn-on level voltage, the sensing reference switch may be in a turned-on state, and the sampling switch may be in a turned-off state.

During the second period, the scanning signal may be a turn-off level voltage, the sensing signal may be the turn-on level voltage, the sensing reference switch may be in a turned-off state, and the sampling switch may be in the turned-off state.

During the third period, the scanning signal may be the turn-off level voltage, the sensing signal may be the turn-on level voltage, the sensing reference switch may be in the turned-off state, and the sampling switch may be in the turned-on state.

The sensing period for the sensing target subpixel may be a real-time sensing period performed in a blank period during display driving.

The voltage of the first reference voltage line may be increased during the second period of the sensing period, and a video driving data voltage to be supplied to the sensing target subpixel may be changed depending on an amount or a rate by which the voltage of the first reference voltage line increases during the sensing period.

According to yet another aspect of the present disclosure, one or more embodiments may provide a driving method of a light-emitting display device including a display panel in which a plurality of data lines and a plurality of gate lines are disposed, a plurality of subpixels defined by the plurality of data lines and the plurality of gate lines are arrayed, and a plurality of reference voltage lines are disposed, a data driver circuit driving the plurality of data lines, and a gate driver circuit driving the plurality of gate lines.

The driving method may include: supplying a sensing data voltage to a sensing target subpixel through a first data line among the plurality of data lines, and supplying a sensing reference voltage to the sensing target subpixel through a first reference voltage line among the plurality of reference voltage lines; increasing a voltage of the first reference voltage line; and detecting the voltage of the first reference voltage line when a predetermined time has passed after a start of the increasing of the voltage of the first reference voltage line.

During the step of increasing the voltage of the first reference voltage line and the step of detecting the voltage of the first reference voltage line, a data line, among the plurality of data lines, crossing the first reference voltage line or a connecting line electrically connected to the first reference voltage line, may be maintained at a voltage different from the sensing data voltage.

During the step of increasing the voltage of the first reference voltage line and the step of detecting the voltage of the first reference voltage line, the data line crossing the first reference voltage line or the connecting line may be maintained at a voltage lower than the sensing data voltage.

During the step of increasing the voltage of the first reference voltage line and the step of detecting the voltage of the first reference voltage line, the data line crossing the first reference voltage line or the connecting line may be maintained at a fake data voltage different from the sensing data voltage and different from a data voltage generated from real video frame data.

The fake data voltage may be a black data voltage.

A sensing period for the sensing target subpixel may be a real-time sensing period performed in a blank period during display driving.

According to another aspect, one or more embodiments may provide a driver circuit of a light-emitting display device including a display panel in which a plurality of data lines and a plurality of gate lines are disposed, a plurality of subpixels defined by the plurality of data lines and the plurality of gate lines are arrayed, and a plurality of reference voltage lines are disposed.

The driver circuit may include: a data voltage output circuit supplying a sensing data voltage to a sensing target subpixel, selected from among the plurality of subpixels, through a first data line; and an analog-to-digital converter detecting a voltage of a first reference voltage line, among the plurality of reference voltage lines, electrically connected to the sensing target subpixel, when a predetermined time has passed after the voltage of the first reference voltage line started to increase.

After the voltage of the first reference voltage line started to increase and before completion of the detection of the voltage of the first reference voltage line, the data voltage output circuit may supply the sensing data voltage to a data line, among the plurality of data lines, crossing the first reference voltage line or a connecting line electrically connected to the first reference voltage line.

After the voltage of the first reference voltage line started to increase and before completion of the detection of the voltage of the first reference voltage line, the data voltage output circuit may supply a voltage lower than the sensing data voltage to the data line crossing the first reference voltage line or the connecting line.

The driver circuit may further include: a sensing reference switch controlling a connection between a sensing reference voltage supply node and the first reference voltage line; and a sampling switch controlling a connection between the first reference voltage line and the analog-to-digital converter.

According to one or more embodiments, it is possible to accurately detect luminance deviations among the subpixels without a sensing error, thereby accurately compensate for the luminance deviations among the subpixels. Consequently, image quality can be improved.

According to one or more embodiments, it is possible to accurately perform the sensing driving in real time during the video driving. Consequently, efficient sensing is possible, and image quality can be improved.

According to one or more embodiments, even in the case that other video control driving for the improvement of image quality is performed during the sensing, a sensing error can be prevented from being caused by the other video control driving, so that an accurate sensing result can be obtained.

According to one or more embodiments, even in the case that fake image driving (e.g., black data insertion driving) corresponding to the other video control driving for the improvement of image quality is performed during the sensing, a sensing error can be prevented from being caused by the fake image driving, so that an accurate sensing result can be obtained.

According to one or more embodiments, even in the case that the fake image driving (e.g., black data insertion driving) is performed during the sensing, the reference voltage line used as a sensing line can be prevented from voltage changes by the fake image driving (e.g., black data insertion driving), so that an accurate sensing result can be obtained.

BRIEF DESCRIPTION OF THE SEVERAL VIEWS OF THE DRAWINGS

The above and other objects, features, and advantages of the present disclosure will be more clearly understood from the following detailed description when taken in conjunction with the accompanying drawings, in which.

DETAILED DESCRIPTION

Figure 1:
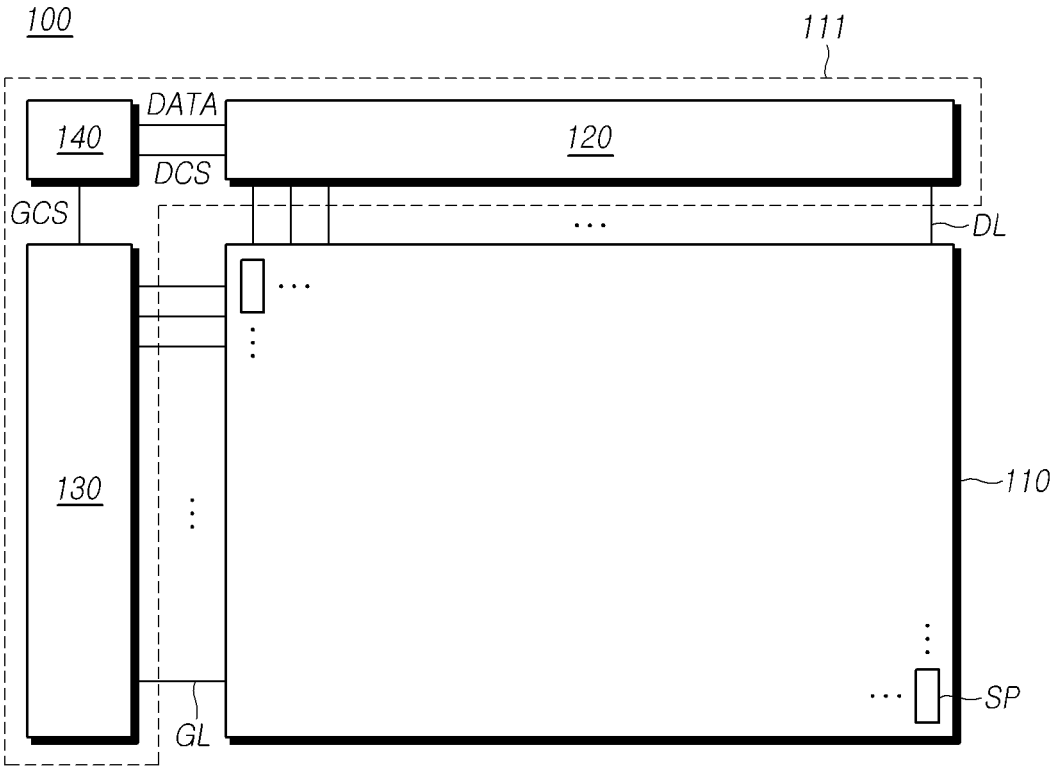
FIG. 1 schematically illustrates a system configuration of an organic light-emitting display device according to one or more embodiments of the present disclosure.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element.

FIG. 1 schematically illustrates a system configuration of an organic light-emitting display device 100 according to one or more embodiments of the present disclosure.

Referring to FIG. 1, the organic light-emitting display device 100 according to one or more embodiments includes a display panel 110 and a driver circuit 111 driving the display panel 110. In the display panel 110, a plurality of data lines DL and a plurality of gate lines GL are disposed, and a plurality of subpixels SP defined by the plurality of data lines DL and the plurality of gate lines GL are arrayed in the form of a matrix.

The driver circuit 111, in terms of the function, may include a data driver circuit 120 driving the plurality of data lines DL, a gate driver circuit 130 driving the plurality of gate lines GL, and a controller 140 controlling the data driver circuit 120 and the gate driver circuit 130.

In the display panel 110, the plurality of data lines DL and the plurality of gate lines GL may overlap each other. For example, the plurality of gate lines GL may be arrayed in rows or columns, while the plurality of data lines DL may be arrayed in columns or rows. Hereinafter, the plurality of gate lines GL will be regarded as being arrayed in rows, while the plurality of data lines DL will be regarded as being arrayed in columns, for the sake of brevity.

Other types of lines may be disposed in the display panel 110, in addition to the plurality of data lines DL and the plurality of gate lines GL.

The controller 140 may supply video data DATA to the data driver circuit 120.

In addition, the controller 140 may control the operation of the data driver circuit 120 and the operation of the gate driver circuit 130 by transferring a variety of control signals DCS and GCS necessary for driving of the data driver circuit 120 and gate driver circuit 130.

The controller 140 starts scanning at points in time defined by frames, outputs converted video data DATA by converting video data input from an external source into a data signal format readable by the data driver circuit 120, and controls data driving at appropriate points in time in response to the scanning.

The controller 140 receives timing signals, such as a vertical synchronization signal Vsync, a horizontal synchronization signal Hsync, an input data enable (DE) signal, and a clock (CLK) signal, and generates and outputs a variety of control signals to the data driver circuit 120 and gate driver circuit 130 in order to control the data driver circuit 120 and gate driver circuit 130.

For example, the controller 140 outputs a variety of gate control signals GCS, including a gate start pulse (GSP) signal, a gate shift clock (GSC) signal, a gate output enable (GOE) signal, and the like, to control the gate driver circuit 130.

In addition, the controller 140 outputs a variety of data control signals DCS, including a source start pulse (SSP) signal, a source sampling clock (SSC) signal, a source output enable (SOE) signal, and the like, to control the data driver circuit 120.

The controller 140 may be a timing controller used in typical display technology, or may be a control device including a timing controller and performing other control functions.

The controller 140 may be provided as a component separate from the data driver circuit 120, or may be provided as an integrated circuit (IC) combined (or integrated) with the data driver circuit 120.

The data driver circuit 120 receives video data DATA from the controller 140 and supplies a data voltage to the plurality of data lines DL to drive the plurality of data lines DL. Herein, the data driver circuit 120 may also be referred to as a source driver circuit.

The data driver circuit 120 may include a shift register, a latch circuit, a digital-to-analog converter (DAC), an output buffer, and the like.

In some cases, the data driver circuit 120 may further include one or more analog-to-digital converters (ADCs).

The gate driver circuit 130 sequentially drives the plurality of gate lines GL by sequentially supplying a scanning signal to the plurality of gate lines GL. Herein, the gate driver circuit 130 may also be referred to as a scan driver circuit.

The gate driver circuit 130 may include a shift register, a level register, and the like.

The gate driver circuit 130 sequentially supplies the scanning signal having an on or off voltage to the plurality of gate lines GL, under the control of the controller 140.

When a specific gate line is opened by the gate driver circuit 130, the data driver circuit 120 converts the video data DATA, received from the controller 140, into an analog data voltage, and supplies the data voltage to the plurality of data lines DL.

The data driver circuit 120 may be disposed on one side of the display panel 110, e.g., above or below the display panel 110. In some cases, the data driver circuit 120 may be disposed on both sides of the display panel 110, e.g., above and below the display panel 110, depending on the driving system, the design of the panel, or the like.

The gate driver circuit 130 may be disposed on one side of the display panel 110, e.g., to the right or left of the display panel 110. In some cases, the gate driver circuit 130 may be disposed on both sides of the display panel 110, e.g., to the right and left of the display panel 110, depending on the driving system, the design of the panel, or the like.

The data driver circuit 120 may include one or more source driver ICs SDIC.

Each of the source driver ICs SDIC may be connected to a bonding pad of the display panel 110 by a tape-automated bonding (TAB) method or by a chip-on-glass (COG) method, may directly mounted on the display panel 110, or in some cases, may be integrated with the display panel 110. In addition, each of the source driver ICs may be implemented using a chip-on-film (COF) structure mounted on a film connected to the display panel 110. In this case, the source driver ICs may be mounted on circuit films to be electrically connected to the data lines DL in the display panel 110 via the circuit films.

The gate driver circuit 130 may include one or more gate driver ICs GDICs connected to bonding pads of the display panel PNL by a TAB method or a COG method. In addition, the gate driver circuit 130 may be implemented using a gate-in-panel (GIP) structure disposed directly on the display panel 110. In addition, the gate driver circuit 130 may be implemented using a COF structure. In this case, the gate driver circuits of the gate driver circuit 130 may be mounted on circuit films to be electrically connected to the gate lines GL in the display panel 110 via the circuit film.

Figure 2:
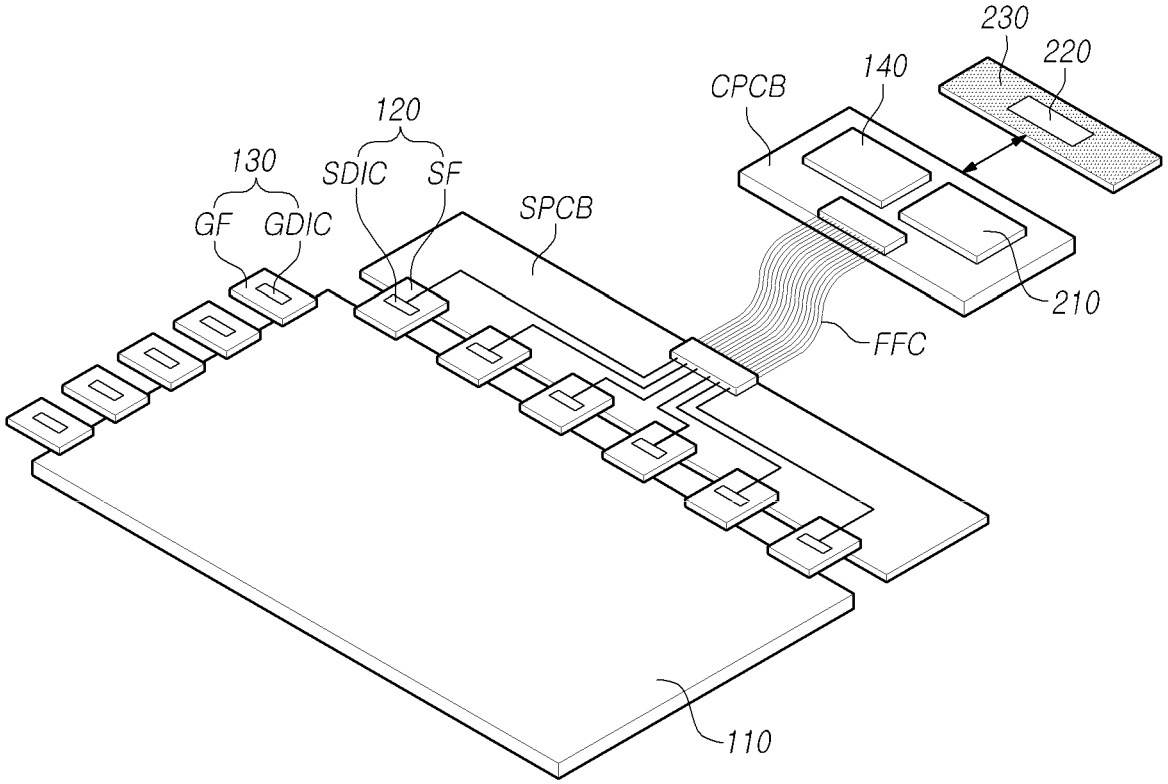
FIG. 2 illustrates a system configuration of the organic light-emitting display device according to one or more embodiments of the present disclosure.

FIG. 2 illustrates a system configuration of the organic light-emitting display device 100 according to one or more embodiments of the present disclosure.

Referring to FIG. 2, each of the source driver ICs SDIC of the data driver circuit 120 are implemented using a COF structure among a plurality of methods, such as TAB, COG, and COF, while the gate driver circuit 130 is implemented using a plurality of methods, such TAB, COG, COF, and GIP. Other suitable methods can be used to implement the aforementioned structures.

The source driver ICs SDIC of the data driver circuit 120 may be mounted on source-side circuit films SF, respectively.

One portion of each of the films SF may be electrically connected to the display panel 110.

Lines, through which the source driver ICs SDIC and the display panel 110 are electrically connected, may be disposed on the source-side circuit films SF.

The organic light-emitting display device 100 may include at least one source printed circuit board SPCB and a control printed circuit board CPCB, on which control components and a variety of electric devices are mounted, in order to provide circuit connections of the plurality of source driver ICs SDIC to the other devices.

The other portion of each of the films SF, on which the source driver ICs SDIC are mounted, may be electrically connected to the at least one source printed circuit board SPCB.

That is, one portion of each of the films SF, on which the source driver ICs SDIC are mounted, may be electrically connected to the display panel 110, and the other portion of each of the films SF may be electrically connected to the source printed circuit board SPCB.

The controller 140, a power management IC (PMIC) 210, and the like, may be mounted on the control printed circuit board CPCB. The controller 140 controls the operation of the data driver circuit 120, the gate driver circuit 130, and the like. The power management IC 210 supplies various forms of voltage or current to the display panel 110, the data driver circuit 120, the gate driver circuit 130, and the like, or controls various forms of voltage or current to be supplied to the same.

A circuit connection between the at least one source printed circuit board SPCB and the control printed circuit board CPCB may be enabled by at least one connecting member. Here, the connecting member may be, for example, a flexible printed circuit (FPC), a flexible flat cable (FFC), or the like.

The at least one source printed circuit board SPCB and the control printed circuit board CPCB may be integrated (or combined) into a single printed circuit board.

The organic light-emitting display device 100 may further include a set board 230 electrically connected to the control printed circuit board CPCB. The set board 230 may also be referred to as a power board.

A main power management circuit (M-PMC) 220 performing overall power management of the organic light-emitting display device 100 may be present on the set board 230.

The power management IC 210 is a circuit managing the power of a display module including the display panel 110 and the driving circuits 120, 130, and 140 of the display panel 110. The main power management circuit 220 is a circuit managing the power of the entire system, including the display module. The main power management circuit 220 may work in concert with the power management IC 210.

Each of the subpixels SP, arrayed in the display panel 110 of the organic light-emitting display device 100 according to one or more embodiments, may include an organic light-emitting diode (OLED), e.g., a self-light-emitting element, and a driving transistor, e.g., a circuit element driving the organic light-emitting diode.

The type and number of circuit elements of each of the subpixels SP may be variously determined, depending on the function provided, the design, or the like.

Figure 3:
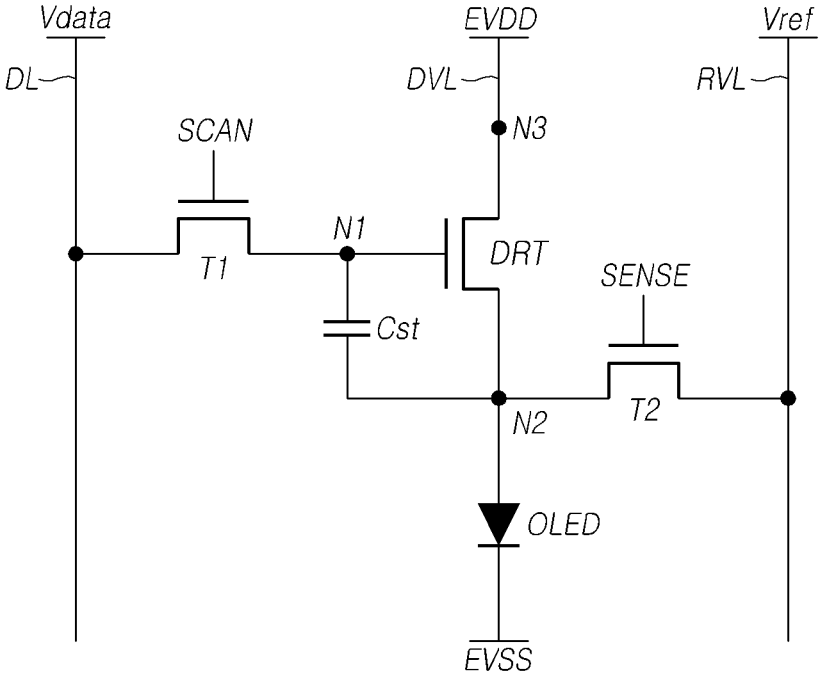
FIG. 3 illustrates a subpixel circuit in the display panel according to one or more embodiments of the present disclosure.

FIG. 3 illustrates a subpixel circuit in the display panel 110 according to one or more embodiments.

The plurality of data lines DL, the plurality of gate lines GL, a plurality of driving voltage lines DVL, and a plurality of reference voltage lines RVL may be disposed in the display panel 110 according to one or more embodiments.

In the organic light-emitting display device 100 according to one or more embodiments, each of the subpixels SP may include an OLED, a driving transistor DRT driving the OLED, a scanning transistor T1 electrically connected between a first node N1 of the driving transistor DRT and a corresponding data line DL among the plurality of data lines DL, a sensing transistor T2 electrically connected between a second node N2 of the driving transistor DRT and a corresponding reference voltage line RVL among the plurality of reference voltage lines RVL, and a storage capacitor Cst electrically connected to the first node N1 and a second node N2 of the driving transistor DRT.

The OLED may include an anode, an organic light-emitting layer, a cathode, and the like.

Referring to the circuit in FIG. 3, the anode of the OLED may be electrically connected to the second node N2 of the driving transistor DRT. A base voltage EVSS may be applied to the cathode of the OLED.

Herein, the base voltage EVSS may be, for example, a ground voltage or a voltage higher or lower than the ground voltage. In addition, the base voltage EVSS may vary depending on the driving conditions. For example, the base voltage EVSS in video driving and the base voltage EVSS in sensing driving may be set to be different from each other.

The driving transistor DRT drives the OLED by supplying driving current to the OLED.

The driving transistor DRT may include the first node N1, the second node N2, a third node N3, and the like.

The first node N1 of the driving transistor DRT may be a gate node, and may be electrically connected to a source node or a drain node of the scanning transistor T1. The second node N2 of the driving transistor DRT may be a source node or a drain node, may be electrically connected to the anode (or cathode) of the OLED, and may be connected to a source node or a drain node of the sensing transistor T2. The third node N3 of the driving transistor DRT may be a drain node or a source node, to which a driving voltage EVDD is applied, may be electrically connected to a driving voltage line DVL, through which the driving voltage EVDD is supplied. Hereinafter, the first node, the second node N2, and the third node N3 of the driving transistor DRT will be regarded as being the gate node, the source node, and the drain node, respectively, by way of example, for the sake of brevity.

The storage capacitor Cst may be electrically connected between the first node N1 and the second node N2 of the driving transistor DRT to maintain the data voltage Vdata corresponding to a video signal voltage or a voltage corresponding to the data voltage Vdata during a one-frame period (or a predetermined period).

The drain node or the source node of the scanning transistor T1 may be electrically connected to a corresponding data line DL. The source node or the drain node of the scanning transistor T1 may be electrically connected to the first node N1 of the driving transistor DRT. The gate node of the scanning transistor T1 may be electrically connected to a corresponding gate line, through which a scanning signal SCAN is applied.

The scanning transistor T1 may be on-off controlled by the scanning signal SCAN applied to the gate node thereof through the corresponding gate line.

The scanning transistor T1 may be turned on by the scanning signal SCAN to transfer the data voltage Vdata, supplied from the corresponding data line DL, to the first node N1 of the driving transistor DRT.

A drain node or a source node of the sensing transistor T2 may be electrically connected to the reference voltage line RVL, while the source node or the drain node of the sensing transistor T2 may be electrically connected to the second node N2 of the driving transistor DRT. The gate node of the sensing transistor T2 may be electrically connected to a corresponding gate line, through which a sensing signal SENSE is applied thereto.

The sensing transistor T2 may be on-off controlled by the sensing signal SENSE applied to the gate node thereof through the corresponding gate line.

The sensing transistor T2 may be turned on by the sensing signal SENSE to transfer the reference voltage Vref, supplied from the corresponding reference voltage line RVL, to the second node N2 of the driving transistor DRT.

The storage capacitor Cst may be an external capacitor intentionally designed to be disposed externally of the driving transistor DRT, rather than a parasitic capacitor, such as, Cgs or Cgd, e.g., an internal capacitor present between the first node N1 and the second node N2 of the driving transistor DRT.

Each of the driving transistor DRT, the scanning transistor T1, and the sensing transistor T2 may be an n-type transistor or a p-type transistor.

Here, the scanning signal SCAN and the sensing signal SENSE may be separate gate signals. In this case, the scanning signal SCAN and the sensing signal SENSE may be applied to the gate node of the scanning transistor T1 and the gate node of the sensing transistor T2 through different gate lines, respectively.

In some cases, the scanning signal SCAN and the sensing signal SENSE may be the same gate signal. In this case, the scanning signal SCAN and the sensing signal SENSE may be commonly applied to the gate node of the scanning transistor T1 and the gate node of the sensing transistor T2 through the same gate line.

The subpixel structure illustrated in FIG. 3 is a three transistor and one capacitor (3T1C) structure, presented for illustrative purposes only, and in some cases, one or more transistors or one or more capacitors may further be included. Additionally or alternatively, the plurality of subpixels may have the same structure, or some subpixels among the plurality of subpixels may have a different structure from the remaining subpixels.

Hereinafter, a video driving operation of each of the subpixels SP will be described briefly by way of example.

The display driving operation (also referred to as the video driving operation) of each of the subpixels SP may include a video data writing step, a boosting step, and a light emission step.

In the video data writing step, a video-driving data voltage Vdata corresponding to a video signal may be applied to the first node N1 of the driving transistor DRT, and a video-driving reference voltage Vref may be applied to the second node N2 of the driving transistor DRT. Here, a voltage Vref similar to the video-driving reference voltage Vref may be applied to the second node N2 of the driving transistor DRT, due to resistance components between the second node N2 of the driving transistor DRT and the reference voltage line RVL.

The video-driving reference voltage Vref is also indicated by VpreR.

In the video data writing step, the scanning transistor T1 and the sensing transistor T2 may be turned on at the same time or with a slight time difference.

In the video data writing step, the storage capacitor Cst may be charged with an electric charge corresponding to a potential difference between both ends, e.g., Vdata−Vref or Vdata−Vref'.

Application of the video-driving data voltage Vdata to the first node N1 of the driving transistor DRT is referred to as video data writing.

In the boosting step subsequent to the video data writing step, the first node N1 and the second node N2 of the driving transistor DRT may be electrically floated at the same time or with a slight time difference.

In this regard, the scanning transistor T1 may be turned off by the turn-off level voltage of the scanning signal SCAN. In addition, the sensing transistor T2 may be turned off by the turn-off level voltage of the sensing signal SENSE.

In the boosting step, the voltage of the first node N1 and the voltage of the second node N2 of the driving transistor DRT may be boosted while the voltage difference between the first node N1 and the second node N2 of the driving transistor DRT is maintained.

When the boosted voltage of the second node N2 of the driving transistor DRT reaches a certain voltage level or higher through the boosting of the voltages of the first node N1 and the second node N2 of the driving transistor DRT during the boosting step, the operation enters the light emission step. Here, the certain voltage level may refer to a voltage level that is higher than the base voltage EVSS by an amount equal to the threshold voltage of the OLED, and that can turn the OLED on.

In this light emission step, driving current flows to the OLED. Then, the OLED can emit light.

The driving transistor DRT, disposed in each of the plurality of subpixels SP arrayed in the display panel 110 according to one or more embodiments, has unique characteristics, such as threshold voltage or mobility (also referred to electron mobility).

The driving transistor DRT may be deteriorated as the driving time elapses. Thus, the unique characteristics of the driving transistor DRT may change according to the driving time.

On-off times of the driving transistor DRT may change with changes in the characteristics. That is, points in time at which current is supplied to the OLED and the amount of current supplied to the OLED may change with changes in the characteristics. Due to such changes in the characteristics of the driving transistor DRT, the actual luminance level of the corresponding subpixel SP may be different from an intended luminance level.

In addition, the plurality of subpixels SP, arrayed in the display panel 110, may have different driving times. Accordingly, the driving transistors DRT in the subpixels SP may have deviations in the characteristics, e.g., deviations in threshold voltage and mobility.

Such deviations in the characteristics among the driving transistors DRT may lead to different luminance levels among the subpixels SP. Accordingly, the luminance uniformity of the display panel 110 may be deteriorated, thereby degrading image quality.

In this regard, according to one or more embodiments, the organic light-emitting display device 100 may include a compensation circuit able to compensate for the characteristics deviations among the driving transistors DRT, and may provide a compensation method using the compensation circuit. These features will be described in more detail with reference to FIGS. 4 to 7.

Figure 4:
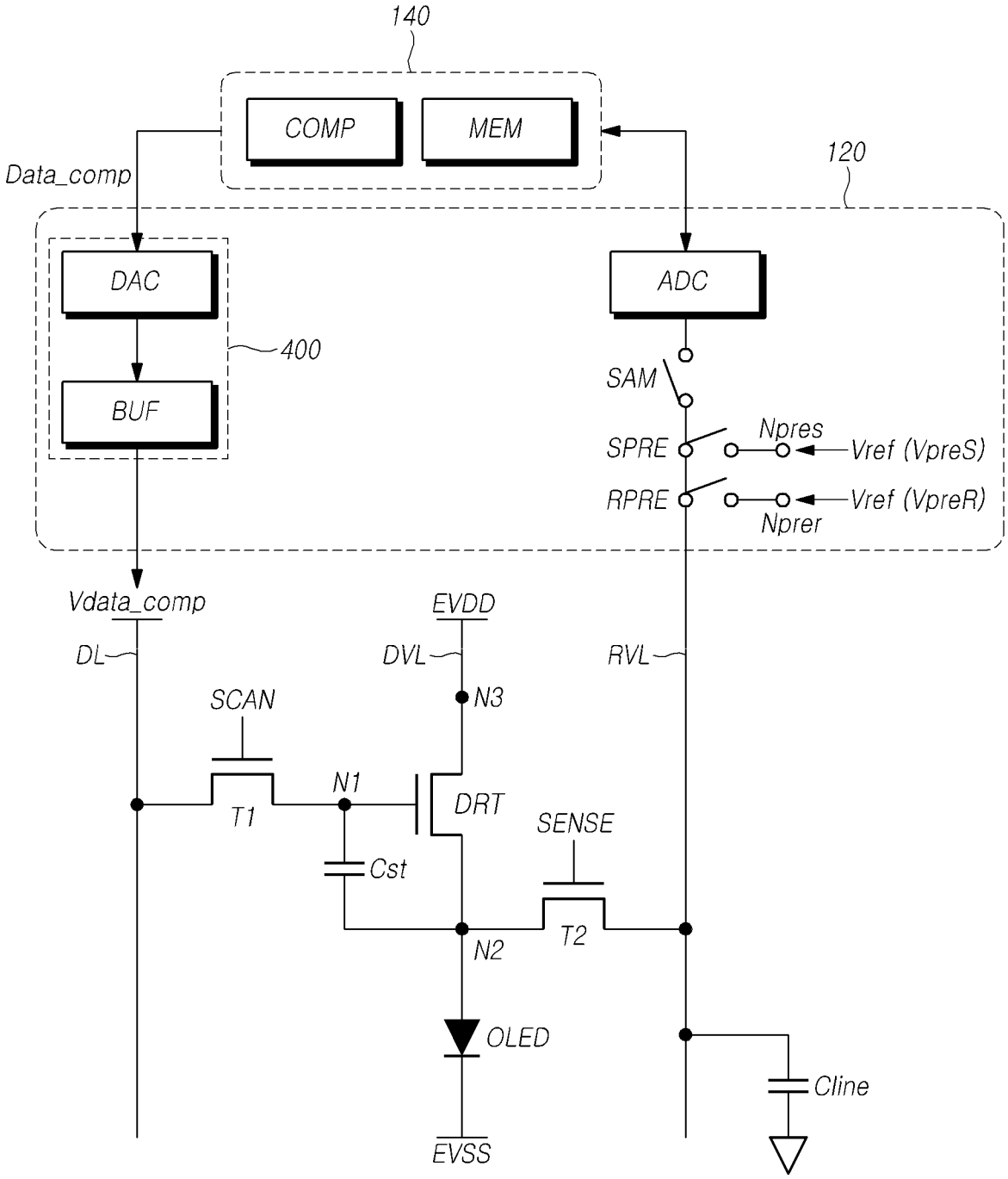
FIG. 4 illustrates a compensation circuit of the organic light-emitting display device according to one or more embodiments of the present disclosure.

FIG. 4 illustrates a compensation circuit of the organic light-emitting display device 100 according to one or more embodiments.

The organic light-emitting display device 100 according to one or more embodiments may detect characteristics, or a change in characteristics, of the driving transistors DRT, in order to compensate for characteristics deviations among the driving transistors DRT.

The compensation circuit of the organic light-emitting display device 100 according to one or more embodiments may include components for sensing the characteristics, or the change in the characteristics, of the driving transistors DRT in the subpixels SP, by driving (sensing driving) the subpixels having a 3T1C structure or a structure modified from the 3T1C structure.

The organic light-emitting display device 100 according to one or more embodiments may detect a voltage of the reference voltage line RVL by the sensing driving, and may determine the characteristics, or the change in the characteristics, of the driving transistor DRT in the subpixel SP, from the detected voltage. Here, the reference voltage line RVL may not only serve to transfer the reference voltage but also serve as a sensing line to detect the characteristics of the subpixel, e.g., the characteristics of the driving transistor DRT. Thus, the reference voltage line RVL may also be referred to as a sensing line.

More specifically, in response to the sensing driving of the organic light-emitting display device 100 according to one or more embodiments, the characteristics, or the change in the characteristics, of the driving transistor DRT, is reflected as a voltage, e.g., Vdata−Vth, of the second node N2 of the driving transistor DRT.

The voltage of the second node N2 of the driving transistor DRT may correspond to the voltage of the reference voltage line RVL if the sensing transistor T2 is in a turned-on state. A line capacitor Cline on the reference voltage line RVL may be charged by the voltage of the second node N2 of the driving transistor DRT. Due to the charged line capacitor Cline, the reference voltage line RVL may have a voltage corresponding to the voltage of the node N2 of the driving transistor DRT.

The compensation circuit of the organic light-emitting display device 100 according to one or more embodiments may perform compensation driving by on-off controlling the scanning transistor T1 and the sensing transistor T2 in the subpixel SP serving as a sensing target, and controlling the supply of the data voltage Vdata and the supply of the reference voltage Vref, so that the second node N2 of the driving transistor DRT has a voltage condition reflecting the characteristics, e.g., threshold voltage or mobility, or the change of the characteristics, of the driving transistor DRT.

The compensation circuit may include an analog-to-digital converter ADC and a switch circuit. The analog-to-digital converter ADC measures the voltage of the reference voltage line RVL, corresponding to the voltage of the second node N2 of the driving transistor DRT, and converts the measured voltage into a digital sensing value. The switch circuit is provided for the sensing driving.

The sensing driving switch circuit may include a sensing reference switch SPRE controlling the connection between each reference voltage line RVL and a sensing reference voltage supply node Npres, to which the reference voltage Vref is supplied, and a sampling switch SAM controlling the connection between the reference voltage line RVL and the analog-to-digital converter ADC.

The sensing reference switch SPRE is a switch used in the sensing driving. Due to the sensing reference switch SPRE, the reference voltage Vref, supplied to the reference voltage line RVL, is regarded as a "sensing reference voltage VpreS."

Referring to FIG. 4, the switch circuit may further include a video driving reference switch RPRE used in the video driving.

The video driving reference switch RPRE may control connection between each reference voltage line RVL and a video driving reference voltage supply node Nprer, to which the reference voltage Vref is supplied.

The video driving reference switch RPRE is a switched used in the video driving. The reference voltage Vref, supplied to the reference voltage line RVL by the video driving reference switch RPRE, is a "video driving reference voltage VpreR."

The sensing reference switch SPRE and the video driving reference switch RPRE may be provided separately or may be integrated (or combined) into a single switch. The sensing reference voltage VpreS and the video driving reference voltage VpreR may be the same value or different values.

The compensation circuit of the organic light-emitting display device 100 according to one or more embodiments may further include a memory MEM and a compensator COMP. The memory MEM stores a sensing value output by the analog-to-digital converter ADC, or retains a reference sensing value that has been previously stored. The compensator COMP determines a compensation value, by which characteristics deviations are compensated, by comparing the sensing value stored in the memory MEM and the reference sensing value.

The compensation value determined by the compensator COMP may be stored in the memory MEM.

The controller 140 may change the video data Data, supposed to be supplied to the data driver circuit 120, using the compensation value determined by the compensator COMP, and output the changed video data Data_comp to the data driver circuit 120.

Then, the data driver circuit 120 may convert the changed video data Data_comp into a data voltage Vdata_comp in the form of an analog signal using the digital-to-analog converter DAC, and may output the converted data voltage Vdata_comp to the corresponding data line DL via an output buffer BUF. Accordingly, the characteristics deviations, e.g., the threshold voltage deviations or electron mobility deviations of the driving transistor DRT of the corresponding subpixel SP can be compensated. With the compensation, uniform luminance of the subpixels SP can be provided.

Referring to FIG. 4, the data driver circuit 120 may include a data voltage output circuit 400 including a latch circuit, the digital-to-analog converter DAC, the output buffer BUF, and the like. In some cases, the data driver circuit 120 may further include an analog-to-digital converter ADC and a plurality of switches SAM, SPRE, and RPRE.

Additionally or alternatively, the analog-to-digital converter ADC and the plurality of switches SAM, SPRE, and RPRE may be located outside of the data driver circuit 120, instead of being disposed within the data driver circuit 120.

Referring to FIG. 4, although the compensator COMP may be present outside of the controller 140, the compensator COMP may be included within the controller 140. In addition, the memory MEM may be located outside of the controller 140, or may be provided in the form of a register within the controller 140.

Figure 5:
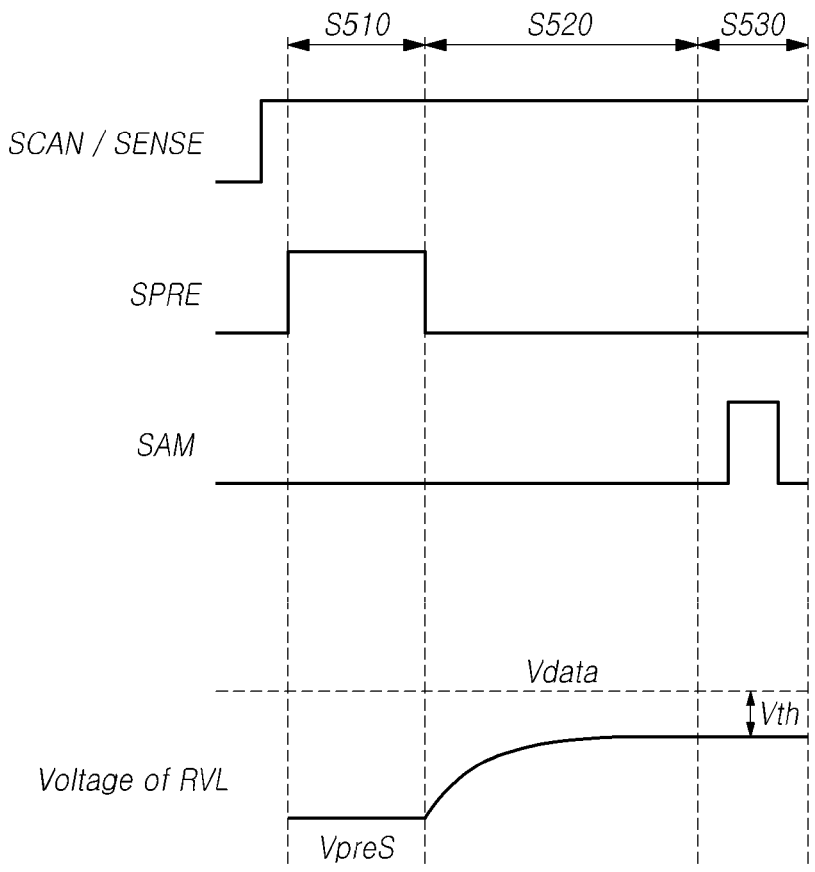
FIG. 5 illustrates a driving timing diagram for threshold voltage sensing in the organic light-emitting display device according to one or more embodiments of the present disclosure.

FIG. 5 illustrates a driving timing diagram for threshold voltage sensing in the organic light-emitting display device 100 according to one or more embodiments.

Referring to FIG. 5, the threshold voltage sensing driving may include an initialization step S510, a tracking step S520, and a sampling step S530.

In the initialization step S510, the scanning transistor T1 is turned by a scanning signal SCAN having a turn-on level voltage. Then, the first node N1 of the driving transistor DRT is initialized to a threshold voltage sensing data voltage Vdata.

In the initialization step S510, a sensing signal SENSE having a turn-on level voltage causes the sensing transistor T2 to be in a turned-on state, and the sensing reference switch SPRE is in a turned-on state. Consequently, the second node N2 of the driving transistor DRT is initialized to a sensing reference voltage VpreS.

The tracking step S520 is a step of tracking the threshold voltage Vth of the driving transistor DRT. That is, in the tracking step S520, the voltage of the second node N2 of the driving transistor DRT, reflecting the threshold voltage Vth of the driving transistor DRT, is tracked.

In the tracking step S520, the scanning transistor T1 and sensing transistor T2 maintain turned-on states, while the sensing reference switch SPRE is turned off. Consequently, the second node N2 of the driving transistor DRT is floated, and the voltage of the second node N2 of the driving transistor DRT starts to increase from the sensing reference voltage VpreS.

Since the sensing transistor T2 is in the turned-on state, an increase in the voltage of the second node N2 of the driving transistor DRT causes a voltage increase in the reference voltage line RVL.

The voltage of the second node N2 of the driving transistor DRT is saturated after having increased. The saturated voltage of the second node N2 of the driving transistor DRT corresponds to a voltage difference Vdata−Vth obtained by deducting the threshold voltage Vth of the driving transistor DRT from the threshold voltage sensing data voltage Vdata.

Thus, when the voltage of the second node N2 of the driving transistor DRT is saturated, the voltage of the reference voltage line RVL corresponds to the voltage difference Vdata−Vth between the threshold voltage sensing data voltage Vdata and the threshold voltage Vth of the driving transistor DRT.

When the voltage of the second node N2 of the driving transistor DRT is saturated, the sampling switch SAM is turned on, so that the sampling step S530 is performed.

In the sampling step S530, the analog-to-digital converter ADC may detect the voltage of the reference voltage line RVL connected via the sampling switch SAM, and may convert the detected voltage to a digital sensing value. Here, the voltage detected by the analog-to-digital converter ADC corresponds to "Vdata−Vth."

The compensator COMP may determine the threshold voltage of the driving transistor DRT of the corresponding subpixel SP, on the basis of the sensing value output from the analog-to-digital converter ADC, and may compensate for the determined threshold voltage of the driving transistor DRT.

The compensator COMP may determine the threshold voltage Vth of the driving transistor DRT from the sensing value (e.g., a digital value corresponding to Vdata−Vth) measured for the sensing driving and the already-known threshold voltage sensing data (e.g., a digital value corresponding to Vdata).

The compensator COMP may compensate for threshold voltage deviations among the driving transistors DRT by comparing the determined threshold voltage Vth of the corresponding driving transistor DRT with the reference threshold voltage or the threshold voltage of another driving transistor DRT. Here, the threshold voltage deviations compensation may mean a video data changing process, e.g., a process of adding or deducting a compensation value (or an offset) to or from the video data.

Figure 6:
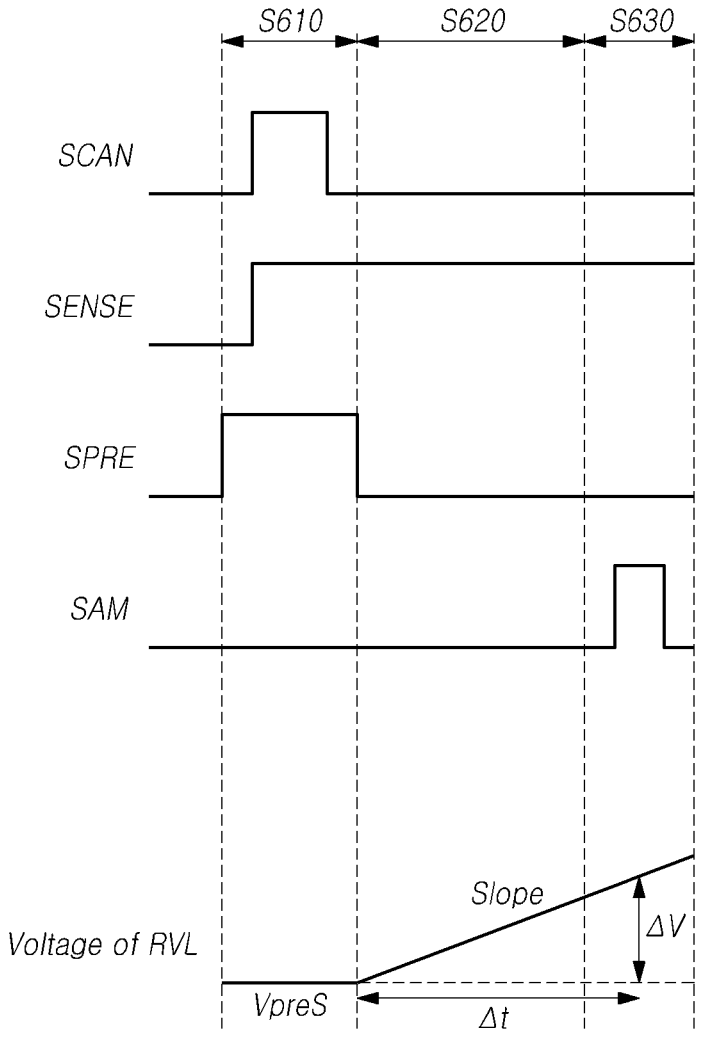
FIG. 6 illustrates a driving timing diagram for mobility sensing in the organic light-emitting display device according to one or more embodiments of the present disclosure.

FIG. 6 illustrates a driving timing diagram for mobility sensing in the organic light-emitting display device 100 according to one or more embodiments.

Referring to FIG. 6, the mobility sensing driving may include an initialization step S610, a tracking step S620, and a sampling step S630.

In the initialization step S610, the scanning transistor T1 is turned on by a scanning signal SCAN having a turn-on level voltage. Then, the first node N1 of the driving transistor DRT is initialized to the mobility sensing data voltage Vdata.

In the initialization step S610, a sensing signal SENSE having a turn-on level voltage turns on the sensing transistor T2, and the sensing reference switch SPRE is in a turned-on state. Then, the second node N2 of the driving transistor DRT is initialized to the sensing reference voltage VpreS.

The tracking step S620 is a step of tracking the mobility of the driving transistor DRT. The mobility of the driving transistor DRT may indicate current driving ability of the driving transistor DRT. That is, in the tracking step S620, the voltage of the second node N2 of the driving transistor DRT, based on which the mobility of the driving transistor DRT can be determined, is tracked.

In the tracking step S620, the scanning signal SCAN having a turn-off level voltage turns off the scanning transistor T1 and the sensing reference switch SPRE is in a turned-off state. Then, both the first node N1 and the second node N2 of the driving transistor DRT are floated. Consequently, both the voltages of the first node N1 and the second node N2 of the driving transistor DRT are increased. In particular, the voltage of the second node N2 of the driving transistor DRT starts to increase from the sensing reference voltage VpreS.

Since the sensing transistor T2 is in the turned-on state, an increase in the voltage of the second node N2 of the driving transistor DRT causes a voltage increase in the reference voltage line RVL.

If a predetermined time Δt has passed from a point in time at which the voltage of the second node N2 of the driving transistor DRT starts to increase, the sampling switch SAM is turned on, and the sampling step S630 is performed.

In the sampling step S630, the analog-to-digital converter ADC may detect the voltage of the reference voltage line RVL connected by the sampling switch SAM, and may convert the detected voltage into a digital sensing value. Here, the voltage detected by the analog-to-digital converter ADC corresponds to a voltage VpreS+ΔV increased from the sensing reference voltage VpreS by a predetermined voltage ΔV.

The compensator COMP may determine the mobility of the driving transistor DRT of the corresponding subpixel SP, on the basis of the sensing value output from the analog-to-digital converter ADC, and may compensate for the determined mobility of the driving transistor DRT.

The compensator COMP may determine the mobility of the driving transistor DRT, on the basis of the sensing value (e.g., the digital value corresponding to VpreS+ΔV) measured in the sensing driving, the already-known sensing reference voltage VpreS, and the time Δt that has passed.

The mobility of the driving transistor DRT is proportional to a voltage change over time ΔV/Δt of the reference voltage line RVL in the tracking step S620. That is, the mobility of the driving transistor DRT is proportional to a slope in a voltage waveform of the reference voltage line RVL in FIG. 6.

The compensator COMP may compensate for the mobility deviations among the driving transistors DRT by comparing the determined mobility of the corresponding driving transistor DRT with reference mobility or the mobility of another driving transistor DRT. Here, the mobility deviation compensation may mean the video data changing process, e.g., a calculation process of multiplying the video data with the compensation value (gain).

Figure 7:
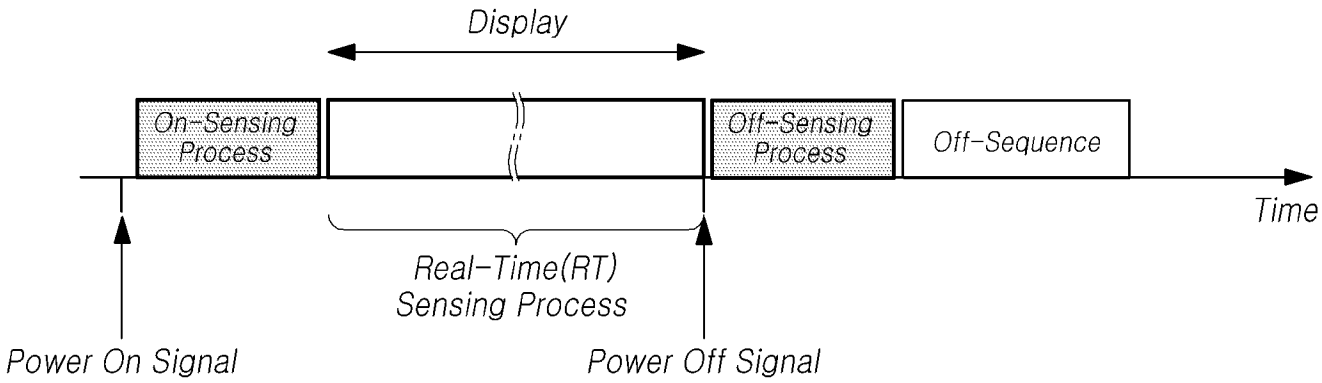
FIG. 7 illustrates a sensing process of the organic light-emitting display device according to one or more embodiments of the present disclosure, performed at more variety of points in time.

FIG. 7 illustrates a sensing process of the organic light-emitting display device 100 according to one or more embodiments, performed at more variety of points in time.

Referring to FIG. 7, when a power-on signal is generated, the organic light-emitting display device 100 performs a predetermined on-sequence process for the start of the display driving, and at the completion of the on-sequence process, starts the display driving normally.

When a power-off signal is generated, the organic light-emitting display device 100 stops the progress of the display driving, performs a predetermined off-sequence process, and at the completion of the off-sequence process, is in a complete off state.

Regarding the timing of such power processing, the sensing driving (e.g., threshold voltage sensing driving or mobility sensing driving) may be performed.

The sensing driving may be performed before the start of the display driving after the power-on signal is generated. Such sensing and such a sensing process may also be referred to as on-sensing and an on-sensing process.

In addition, the sensing driving may be performed after the generation of the power-off signal. Such sensing and such a sensing process may also be referred to as off-sensing and an off-sensing process.

In addition, the sensing driving may be performed in real time during the display driving. Such a sensing process may also be referred to as a real-time (RT) sensing process.

In the case of the real-time sensing process, the sensing driving may be performed on one or more subpixels SP in one or more subpixels lines (e.g., subpixel rows) for every blank period during the display driving.

When the sensing driving (e.g., real-time sensing driving) is performed in the blank period, a subpixel line (e.g., subpixel row), on which the sensing driving is performed, may be selected randomly. This may reduce an abnormal image in the subpixel line, on which the sensing driving has been performed in an active time after the sensing driving in the blank period. In addition, a recovery data voltage corresponding to the data voltage before the sensing driving may be supplied to the subpixels, on which the sensing driving has been performed in the active time after the sensing driving in the blank period. This may further reduce the abnormal image in the subpixel line, on which the sensing driving has been performed in the active time after the sensing driving in the blank period.

In addition, the threshold voltage sensing driving may be performed using the off-sensing process. However, the off-sensing process may take a rather long time, since a large amount of time may be taken for voltage saturation of the second node N2 of the driving transistor DRT.

Since the mobility sensing driving requires a shorter time than the threshold voltage sensing, the mobility sensing driving may be performed using the on-sensing process and/or the real-time sensing process, which is performed for a relatively-short time.

Although the threshold voltage sensing and/or the mobility sensing may be performed using the RF sensing process, it will be assumed hereinafter that the mobility sensing as is performed using the real-time sensing process, for the sake of brevity.

In addition, a single subpixel SP having the structure illustrated in FIG. 3 may be supplied with a single data voltage Vdata and two gate signals SCAN and SENSE, as well as a reference voltage Vref, a driving voltage EVDD, and the like. Accordingly, a single subpixel SP may be electrically connected to a single data line DL, a single or two gate lines GL, a single reference voltage line RVL, and a single driving voltage line DVL (see FIG. 3).

A single or two gate lines GL may be disposed in a single subpixel row to turn a single subpixel row on and off. However, in the following description, a case in which two gate lines GL are disposed in a single subpixel row will be described, for the sake of brevity. According to this assumption, the scanning signal SCAN and the sensing signal SENSE may be transferred through two gate lines GL, respectively.

In addition, since the data voltage Vdata may be supplied to every subpixel SP, a single data line DL may be disposed for every subpixel column. In some cases, a single data lines DL may be commonly disposed for every two subpixel columns.

Since the driving voltage EVDD may be a common voltage, a single driving voltage line DVL may be disposed for every subpixel column (or every subpixel row), or may be disposed for every two or more subpixel columns (or every two or more subpixel rows).

Likewise, since the reference voltage Vref may be a common voltage, a single reference voltage line RVL may be disposed for every subpixel column (or every subpixel row), or may be disposed for every two or more subpixel columns (or every two or more subpixel rows).

In a case in which a single driving voltage line DVL and/or a single reference voltage line RVL is disposed for every two or more subpixel columns (or every two or more subpixel rows), the aperture ratio of the display panel 110 may be further increased.

Hereinafter, a structure for increasing the aperture ratio of the display panel 110, in which a single driving voltage line DVL is disposed for every four or more subpixel columns to be parallel to data lines DL and a single reference voltage line RVL is disposed for every four or more subpixel columns to be parallel to data lines DL, will be described with reference to FIG. 8.

Figure 8:
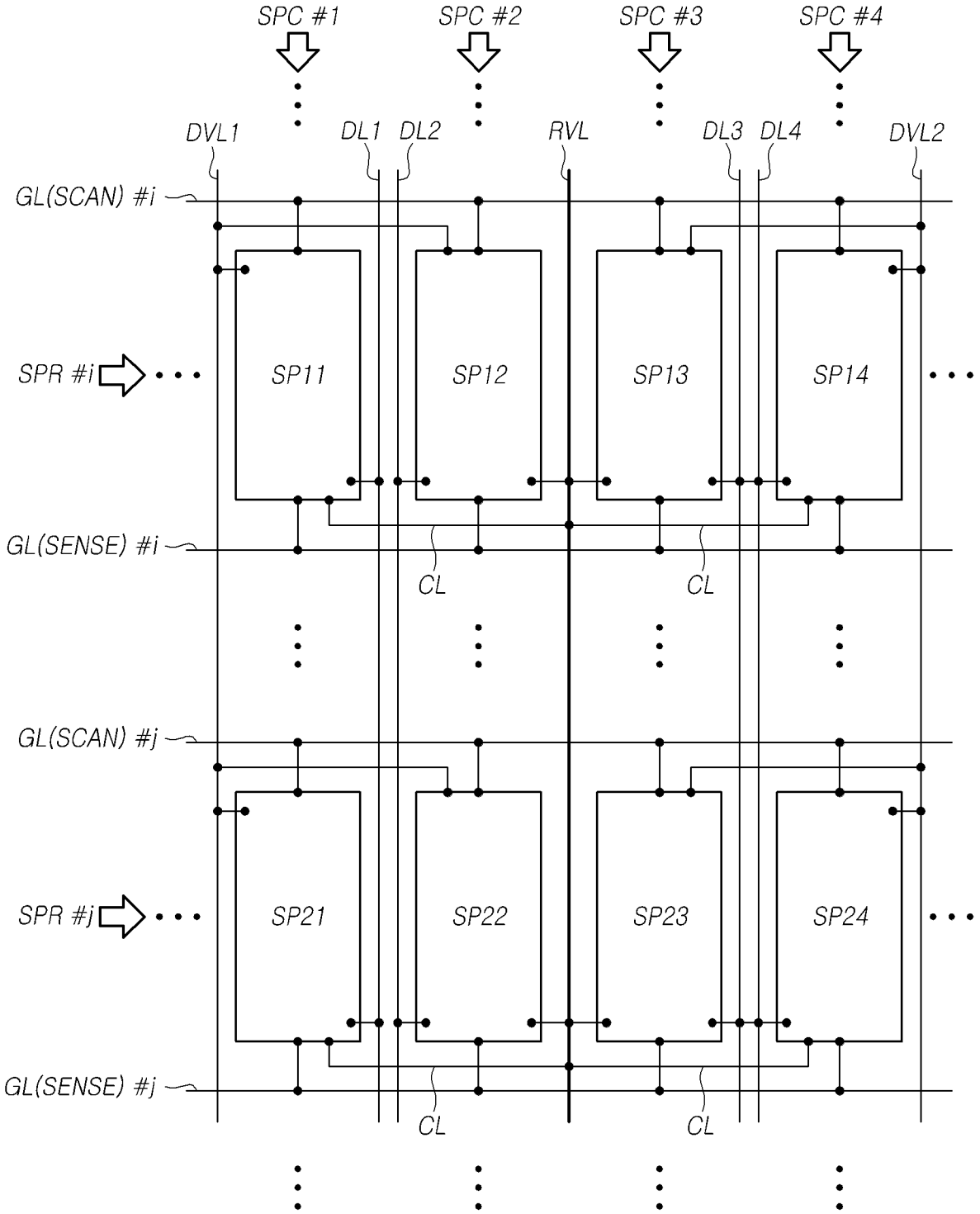
FIG. 8 illustrates an array of subpixels and lines in the organic light-emitting display device according to one or more embodiments of the present disclosure.

FIG. 8 illustrates an array of subpixels SP11, SP12, SP13, SP14, SP21, SP22, SP23, and SP24 and lines DL1 to DL4, DVL1, DVL2, RVL, and . . . in the organic light-emitting display device 100 according to one or more embodiments.

FIG. 8 illustrates a portion of the display panel 110, in particular, portions of two subpixel rows SPR #i and SPR #j.

In two subpixel rows SPR #i and SPR #j, the first subpixel row SPR #i may include four subpixels SP11, SP12, SP13, and SP14, while the second subpixel row SPR #j may include four subpixels SP21, SP22, SP23, and SP24.

In each of the subpixels SP11, SP12, SP13, SP14, SP21, SP22, SP23, and SP24 included in the two subpixel rows SPR #i and SPR #j, the scanning signal SCAN, applied to the gate node of the scanning transistor T1, and the sensing signal SENSE, applied to the gate node of the sensing transistor T2, are regarded as being separate gate signals.

Accordingly, a gate line GL(SCAN) #i, through which the scanning signal SCAN is transferred to the four subpixels SP11, SP12, SP13, and SP14, and a gate line GL(SENSE) #i, through which the sensing signal SENSE is transferred to the four subpixels SP11, SP12, SP13, and SP14, may be disposed in the first subpixel row SPR #i.

Likewise, a gate line GL(SCAN) #j, through which the scanning signal SCAN is transferred to the four subpixels SP21, SP22, SP23, and SP24, and a gate line GL(SENSE) #j, through which the sensing signal SENSE is transferred to the four subpixels SP21, SP22, SP23, and SP24, may be disposed in the second subpixel row SPR #j.

In addition, a first data line DL1, through which the data voltage Vdata is supplied to the subpixels SP11 and SP21 in the first subpixel column SPC #1, a second data line DL2, through which the data voltage Vdata is supplied to the subpixels SP12 and SP22 in the second subpixel column SPC #2, a third data line DL3, through which the data voltage Vdata is supplied to the subpixels SP13 and SP23 in the third subpixel column SPC #3, and a fourth data line DL4, through which the data voltage Vdata is supplied to the subpixels SP14 and SP24 in the fourth subpixel column SPC #4, may be disposed in the display panel 110.

The first data line DL1 and the second data line DL2 may be located between the first subpixel column SPC #1 and the second subpixel column SPC #2. The third data line DL3 and the fourth data line DL4 may be located between the third subpixel column SPC #3 and the fourth subpixel column SPC #4.

Referring to FIG. 8, the driving voltage lines DVL1 and DVL2, through which the driving voltage EVDD, which may be a common voltage, is transferred, and the reference voltage line RVL, through which the reference voltage Vref, which may be a common voltage, is transferred, may be provided as a common structure in order to increase the aperture ratio of the display panel 110. That is, among the driving voltage lines, including DVL1 and DVL2, a single may be disposed for every plurality of subpixel columns, instead of being disposed for every subpixel column. A single reference voltage line RVL may be disposed for every plurality of (or every two or more) subpixel columns, instead of being disposed for every subpixel column.

More specifically, the driving voltage EVDD may be commonly supplied to the first subpixel column SPC #1 and the second subpixel column SPC #2 through the first driving voltage line DVL1. In addition, the driving voltage EVDD may be commonly supplied to the third subpixel column SPC #3 and the fourth subpixel column SPC #4 through the second driving voltage line DVL2.

The reference voltage Vref may be commonly supplied to the first subpixel column SPC #1, the second subpixel column SPC #2, the third subpixel column SPC #3, and the fourth subpixel column SPC #4 through a single reference voltage line RVL.

The single reference voltage line RVL may be disposed between the second subpixel column SPC #2 and the third subpixel column SPC #3. Here, the data lines DL1 to DL4 may be disposed symmetrically with respect to the single reference voltage line RVL. In addition, the driving voltage lines DVL1 and DVL2 may be disposed symmetrically with respect to the single reference voltage line RVL.

The single reference voltage line RVL may be connected directly, or via connecting lines CL, to the drain node or the source node of the sensing transistor T2 included in each of the subpixels SP12 and SP22 in the second subpixel column SPC #2.

The single reference voltage line RVL may be connected directly, or via connecting lines CL, to the drain node or the source node of the sensing transistor T2 included in each of the subpixels SP13 and SP23 in the third subpixel column SPC #3.

The single reference voltage line RVL may be connected directly, or via connecting lines CL, to the drain node or the source node of the sensing transistor T2 included in each of the subpixels SP11 and SP21 in the first subpixel column SPC #1.

The single reference voltage line RVL may be connected directly, or via connecting lines CL, to the drain node or the source node of the sensing transistor T2 included in each of the subpixels SP14 and SP24 in the fourth subpixel column SPC #4.

In other words, all of the subpixels SP11, SP12, SP13, SP14, SP21, SP22, SP23, and SP24, included in the first subpixel column SPC #1, the second subpixel column SPC #2, the third subpixel column SPC #3, and the fourth subpixel column SPC #4, share the single reference voltage line RVL.

Thus, all of the subpixels SP11, SP12, SP13, SP14, SP21, SP22, SP23, and SP24, included in the first subpixel column SPC #1, the second subpixel column SPC #2, the third subpixel column SPC #3, and the fourth subpixel column SPC #4, may belong to a subpixel group sharing the single reference voltage line RVL.

Accordingly, if an abnormality occurs in any one of the subpixels SP11, SP12, SP13, SP14, SP21, SP22, SP23, and SP24 in the subpixel group sharing the single reference voltage line RVL, the abnormality may be spread to the entirety of the subpixel group or influence the remaining subpixels of the subpixel group.

In particular, while the sensing (e.g., threshold voltage sensing or mobility sensing) is being performed on a single first subpixel selected from among the SP11, SP12, SP13, SP14, SP21, SP22, SP23, SP24 in the subpixel group sharing the single reference voltage line RVL as a sensing target, an occurrence of failure in any line in the area of the same subpixel group or in any one of the remaining subpixels may influence the sensing performed on the first subpixel. In this case, the occurrence may influence the first subpixel through the shared reference voltage line RVL, thereby causing an erroneous result in the sensing.

Figure 9:
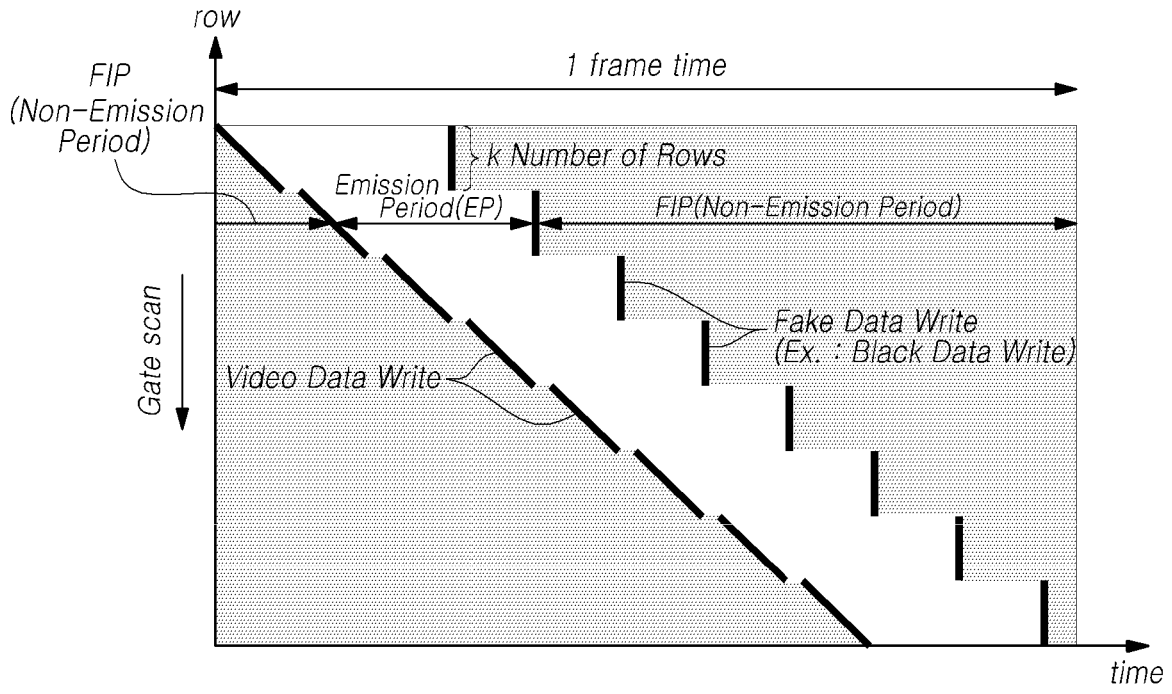
FIG. 9 is a diagram illustrating fake data insertion driving in the organic light-emitting display device according to one or more embodiments of the present disclosure.

FIG. 9 is a diagram illustrating fake data insertion (FDI) driving in the organic light-emitting display device 100 according to one or more embodiments.

In the organic light-emitting display device 100 according to one or more embodiments, the plurality of subpixels SP may be arrayed in the form of a matrix. A plurality of subpixel rows may be present in the display panel 110.

The plurality of gate lines GL corresponding to the plurality of subpixel rows may be driven sequentially. When each subpixel of the subpixels SP has a 3T1C structure, one or two gate lines GL, through which the scanning signal SCAN and the sensing signal SENSE are transferred, may be disposed in each of the plurality of subpixel rows.

In addition, a plurality of subpixel columns may be present in the display panel 110. A single data line DL may be disposed in each of the plurality of subpixel columns, in a corresponding manner.

As in the above-described subpixel driving operation, when the (n+1)th subpixel row among the plurality of subpixel rows is driven, the scanning signal SCAN and the sensing signal SENSE are applied to the subpixels SP, among the plurality of subpixels SP, arrayed in the (n+1)th subpixel row, and a video driving data voltage Vdata is applied to the subpixels SP, arrayed in the (n+1)th subpixel row, through the plurality of data lines DL.

Afterwards, the (n+2)th subpixel row, located below the (n+1)th subpixel row, is driven. The scanning signal SCAN and the sensing signal SENSE are applied to the subpixels SP arrayed in the (n+2)th subpixel row, and the video driving data voltage Vdata is applied to the subpixels SP, arrayed in the (n+2)th subpixel row, through the plurality of data lines DL.

In this manner, video data is written sequentially in the plurality of subpixel rows. Here, the video data writing is the procedure performed in the video data writing step of the subpixel driving operation as described above.

The video data writing step, the boosting step, and the light emission step may be performed sequentially on the plurality of subpixel rows during a one-frame period, in response to the above-described subpixel driving operation.

In addition, as illustrated in FIG. 9, in the plurality of subpixel rows, an emission period EP according to the light emission step of the subpixel driving operation does not continue through the entirety of the one-frame period. Here, the "emission period EP" may also be referred to as a "real image period" or a "real display driving period."

During a period in the one-frame period, except for the emission period EP, a fake image unrelated to real images supposed to be displayed may be displayed. The period in the one-frame period, in which the fake image is displayed, is referred to as a "fake image period (FIP)."

That is, the one-frame period includes an emission period EP and the fake image period FIP, with respect to each of the plurality of subpixel rows. Each of the plurality of subpixel rows performs the real display driving to display real images during the emission period while performing the fake display driving to display the fake image unrelated to real images in the fake image period FIP.

In the fake display driving, fake data is supplied to the corresponding subpixels SP to display the fake image unrelated to real images.

In other words, during the one-frame period, the single subpixel SP emits light during the emission period EP by passing through the video data writing step, the boosting step, and the light emission step while the real display driving is being carried out. Subsequently, the fake display driving is performed. The fake display driving may be performed by inserting the fake image between real images. Thus, the fake display driving is also referred to as the "fake data insertion (FID) driving."

In the real display driving, the video data voltage Vdata corresponding to real images is supplied to the subpixels SP in order to display real images. In contrast, in the fake data insertion driving, a fake data voltage corresponding to the fake image unrelated to real images, is supplied to the subpixels SP.

That is, while the video data voltage Vdata, supplied to the subpixels SP during the real display driving, may vary depending on the frame or the image, the fake data voltage, supplied to the subpixels SP during the fake data insertion driving, may be constant without varying depending on the frame or the image.

According to a method of the fake data insertion driving, a single subpixel row may perform the fake data insertion driving, and then a next single subpixel row may perform the fake data insertion driving.

Additionally or alternatively, according to another method of the fake data insertion driving, a plurality of subpixel rows may simultaneously perform the fake data insertion driving, and then a plurality of next subpixel rows may simultaneously perform the fake data insertion driving. That is, the fake data insertion driving may be performed simultaneously on every plurality of subpixel rows.

The number k of the subpixel rows simultaneously performing the fake data insertion driving may be 2, 4, 8, or the like. However, the present disclosure is not limited thereto and may employ other suitable numbers.

For example, after the video data writing has been performed sequentially on the first to fourth subpixel rows, the fake data voltage may be supplied simultaneously to a plurality of previous subpixel rows disposed ahead of the first subpixel row, the plurality of previous subpixel rows having already passed predetermined emission periods EP thereof.

Subsequently, after the video data writing has been performed sequentially on the fifth to eighth subpixel rows, the fake data voltage may be supplied simultaneously to a plurality of previous subpixel rows disposed ahead of the fifth subpixel rows, the plurality of previous subpixel rows having already passed predetermined emission periods EP thereof.

In addition, the number k of the subpixel rows, on which the fake data insertion driving is performed simultaneously, may be the same or different. In an example, two subpixel rows may simultaneously perform the fake data insertion driving, and then four subpixel rows may simultaneously perform the fake data insertion driving. In another example, four subpixel rows may simultaneously perform the fake data insertion driving, and then eight subpixel rows may simultaneously perform the fake data insertion driving.

When both the real data and the fake data are displayed in a single frame, motion blurring, in which an image is blurred instead of being clearly distinguishable, can be prevented due to the above-described fake data insertion driving, thereby improving image quality.

In the fake data insertion driving as described above, the video data writing and the fake data writing may be performed through the data lines DL.

In addition, since the fake data writing may be performed simultaneously on the plurality of lines (e.g., subpixel rows) as described above, different luminance levels, caused by different lengths of the emission period EP depending on line position, can be compensated, so that an image quality can be improved.

In addition, the lengths of the emission period EP depending on the image can be adaptively adjusted by adjusting the timing of the fake data insertion driving.

The timing of the video data writing and the timing of the fake data writing can be varied by controlling the gate driving.

In addition, the fake data voltage, supplied to the subpixels SP in the fake data insertion driving, may be, for example, a black data voltage.

In this case, the fake data insertion driving may be referred to as black data insertion (BDI) driving. The fake data writing in the fake data insertion driving may be referred to as black data writing. In addition, the fake image period FIP may also be referred to as a black data period.

Figure 10:
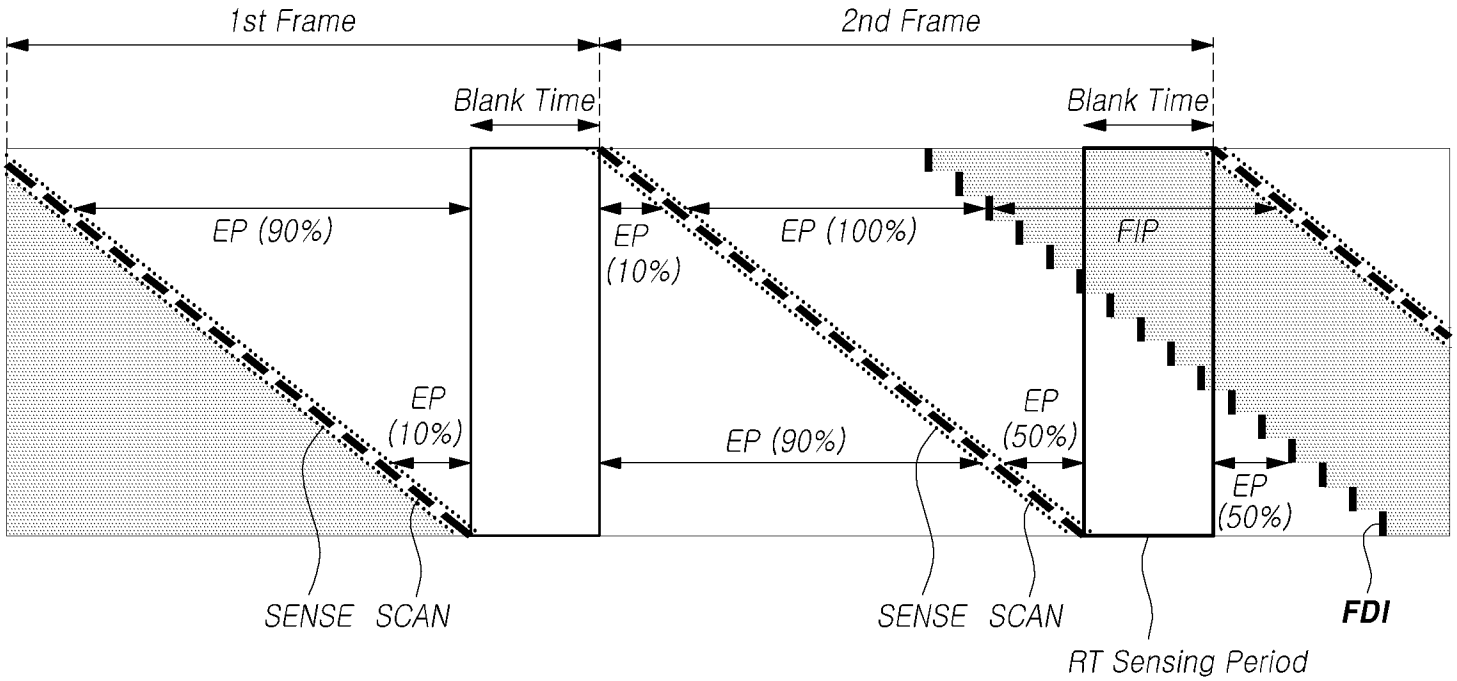
FIG. 10 is a diagram illustrating the real-time sensing driving and the fake data insertion driving in the organic light-emitting display device according to one or more embodiments of the present disclosure.

FIG. 10 is a diagram illustrating the real-time sensing driving and the fake data insertion (FDI) driving in the organic light-emitting display device 100 according to one or more embodiments.

Referring to FIG. 10, the fake data insertion driving may not be performed in a first frame period, while the fake data insertion driving may be performed in a second frame period.

Referring to FIG. 10, during the second frame period, the emission period EP and the fake image period FIP may have the same time lengths or may have different time lengths.

Referring to FIG. 10, during the first frame period in which the fake data insertion driving is not performed, a display driving time is used 100%. However, in the second frame time in which the fake data insertion driving is performed, during the emission period EP except for the fake image period FIP, the display driving time may be used 100%.

In addition, the real-time sensing may be performed in every blank period (or blank time).

The fake data insertion driving is not performed during the real-time sensing performed in the blank period corresponding to (or in) the first frame period. However, in the real-time sensing performed in the blank period corresponding to the second frame time, the fake data insertion driving may be performed on some subpixel rows.

Figure 11:
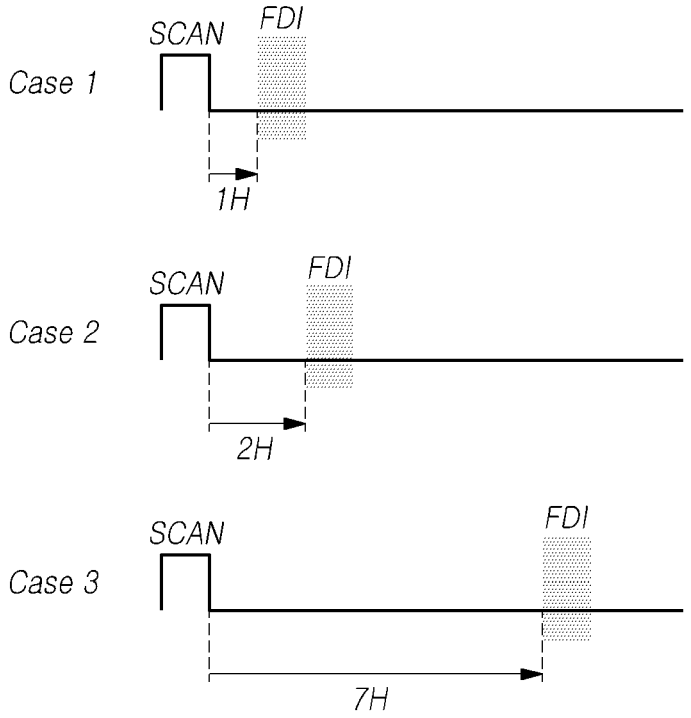
FIG. 11 illustrates three cases of timing relationship between the real-time sensing driving and the fake data insertion driving in the organic light-emitting display device according to one or more embodiments of the present disclosure, in a case in which the fake data insertion driving is performed during the real-time sensing driving.

FIG. 11 illustrates three cases of timing relationship between the real-time sensing driving and the fake data insertion driving in the organic light-emitting display device 100 according to one or more embodiments, in a case in which the fake data insertion driving is performed during the real-time sensing driving.

In the blank period, one subpixel row is selected randomly, according to the rule, or sequentially, and one or more subpixels in the selected subpixel row may be selected as sensing targets.

Here, the number of subpixels, selectable as the sensing targets from among the subpixels included in the subpixel row, may correspond to the number of analog-to-digital converters ADC. That is, subpixels as many as the analog-to-digital converters ADC may be detected simultaneously.

As illustrated in FIG. 10, during the blank period, while the real-time sensing is being performed to detect the mobility of the driving transistor DRT in the subpixel selected as the sensing target from the selected subpixel row, the fake data insertion driving may be performed on other subpixel rows.

Here, a variety of cases may be present, depending on the relationship between the timing of the real-time sensing driving and the timing of the fake data insertion (FDI) driving.

In FIG. 11, the three cases of timing relationship between the real-time sensing driving and the fake data insertion driving are taken by way of example.

For the real-time sensing performed in the blank period, in the initialization step S610, the scanning signal SCAN is supplied to the gate node of the scanning transistor T1 in the corresponding subpixel SP in order to initialize the first node N1 of the driving transistor DRT in the subpixel SP, selected as the sensing target, to the sensing data voltage Vdata. In addition, in the fake data insertion driving, the fake data voltage may be applied to the subpixel row, in which the subpixel selected as the sensing target is present, and other corresponding subpixel rows.

In this regard, the timing relationship between the real-time sensing driving and the fake data insertion driving, based on points in time at which the scanning signal SCAN for initialization in the real-time sensing is applied, will be discussed.

In Case 1, the scanning signal SCAN for initialization in the real-time sensing is applied, and after 1H (horizontal time), the fake data insertion driving may be performed.

In Case 2, the scanning signal SCAN for initialization in the real-time sensing is applied, and after 2H (horizontal time), the fake data insertion driving may be performed.

In Case 3, the scanning signal SCAN for initialization in the real-time sensing is applied, and after 7H (horizontal time), the fake data insertion driving may be performed.

In all of the three cases, after the scanning signal SCAN for initialization in the real-time sensing is applied, the tracking step S620 and the sampling step S630 are performed.

However, if the fake data insertion driving is performed before the tracking step S620 and the sampling step S630 for the real-time sensing are completed, an abnormal image may be created.

Hereinafter, abnormal screen images that may occur when the fake data insertion driving is performed during the real-time sensing will be described in detail with reference to FIGS. 12 to 14.

Figure 12:
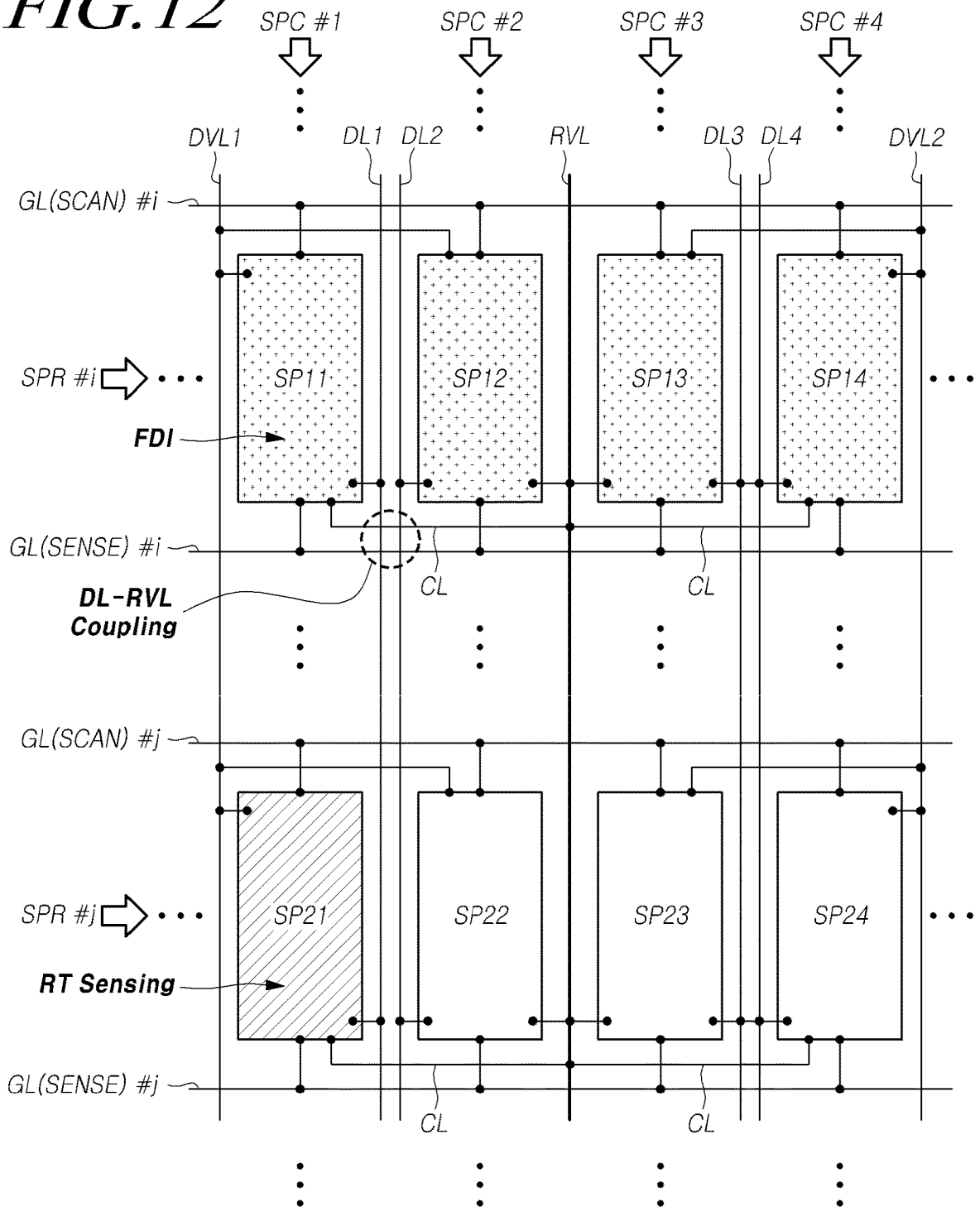
FIG. 12 illustrates electromagnetic interaction between the data lines and the reference voltage line in the organic light-emitting display device according to one or more embodiments of the present disclosure, generated by the fake data insertion driving performed during the real-time sensing driving.

FIG. 12 illustrates electromagnetic interaction between the data lines DL and the reference voltage line RVL in the organic light-emitting display device 100 according to one or more embodiments, generated by the fake data insertion driving performed during the real-time sensing driving. FIG. 13 illustrates graphs of voltage conditions measured from the reference voltage line RVL in the organic light-emitting display device 100 according to one or more embodiments, the voltage conditions being caused to be unstable by the fake data insertion driving performed during the real-time sensing driving. FIG. 14 illustrates a screen of the organic light-emitting display device 100 according to one or more embodiments, in which a degradation in image quality is caused by the fake data insertion driving performed during the real-time sensing driving.

FIG. 12 illustrates an array of subpixels SP11, SP12, SP13, SP14, SP21, SP22, SP23, and SP24 and lines DL1 to DL4, DVL1, DVL2, RVL, which is similar to the configuration shown in FIG. 8.

Referring to FIG. 12, a case, in which the fake data insertion driving is performed on the first subpixel row SPR #i during the blank period while the real-time sensing is performed on the sensing target subpixel SP21 in the second subpixel row SPR #j, will be described.

In the case of the real-time sensing, in the initialization step S610, the first node N1 of the driving transistor DRT in the sensing target subpixel SP21 in the second subpixel row SPR #j may be initialized to the sensing data voltage Vdata. That is, in the initialization step S610 for the real-time sensing, the scanning signal SCAN may be applied to the gate node of the scanning transistor T1 in the sensing target subpixel SP21 in the second subpixel row SPR #j.

In the case of real-time sensing, after the initialization step S610, if the fake data insertion driving is performed on the first subpixel row SPR #i while the tracking step S620 is being performed, the fake data voltage is supplied to the data lines DL1 to DL4.

Consequently, the voltage of the data line DL1, to which the sensing data voltage is applied in the initialization step S610, is converted to the fake data voltage in response to the FDI driving. When the FDI driving is finished, the voltage of the data line DL1 may be changed to the sensing data voltage again. Here, the fake data voltage is a voltage lower than the sensing data voltage.

Accordingly, if the fake data insertion driving is performed during the real-time sensing, a voltage change (or fluctuation) occurs in the data line DL1.

As described above, the data line DL, the voltage of which is changed, may cross the reference voltage line RVL or the connecting line CL connected to the reference voltage line RVL. Since the connecting line CL electrically corresponds to the reference voltage line RVL, the connecting line CL will be described hereinafter as being included in the reference voltage line RVL.

Due to the structure in which the data line DL1 crosses the reference voltage line RVL or the connecting line CL connected to the reference voltage line RVL, the data line DL1 and the reference voltage line RVL may be electromagnetically interact with each other.

Due to the DL-RVL electromagnetic interaction, the voltage change in the data line DL1 may cause a voltage change (e.g., voltage instability) in the reference voltage line RVL.

Figure 13:
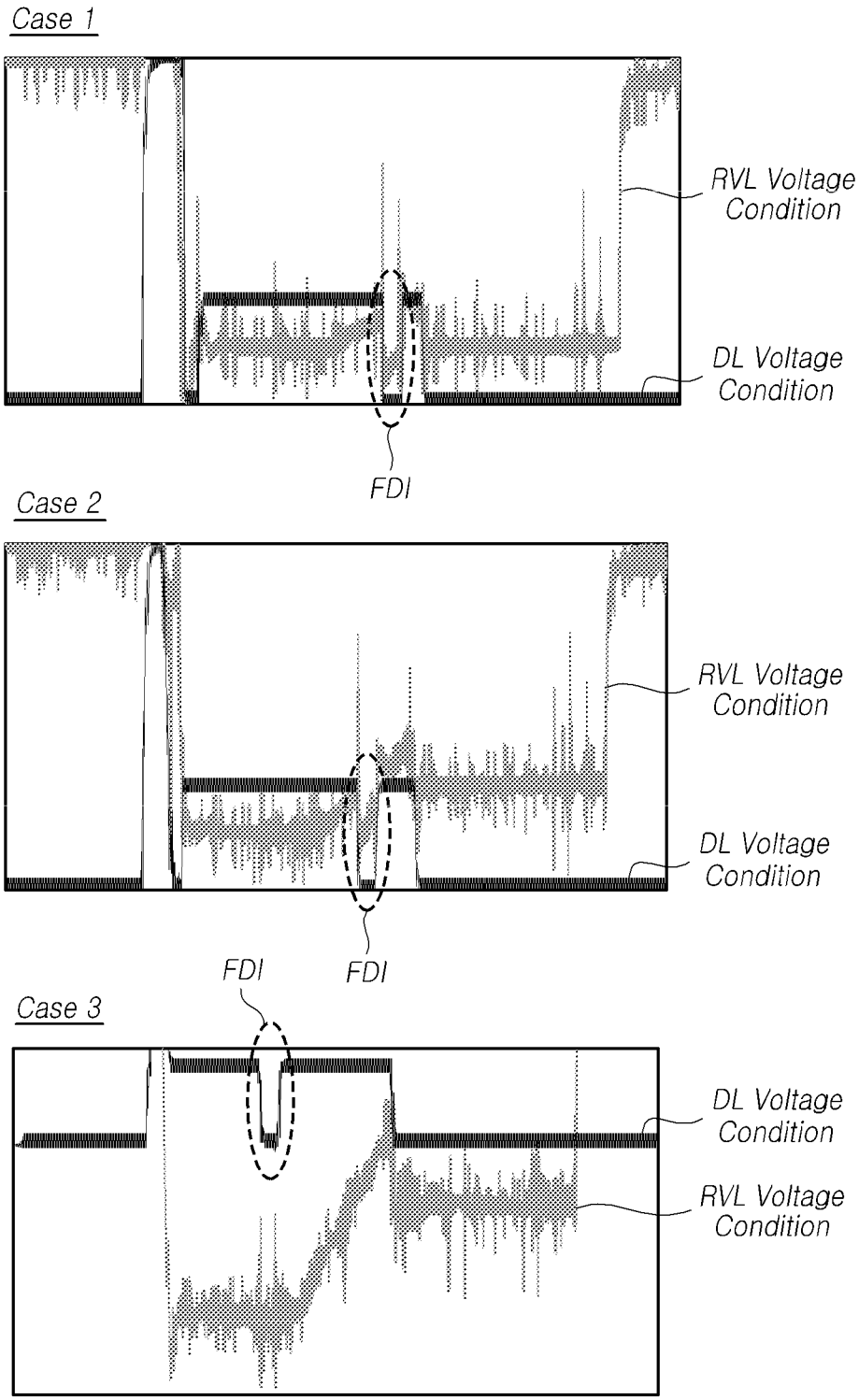
FIG. 13 illustrates graphs of voltage conditions measured from the reference voltage line in the organic light-emitting display device according to one or more embodiments of the present disclosure, the voltage conditions being caused to be unstable by the fake data insertion driving performed during the real-time sensing driving.
Figure 14:
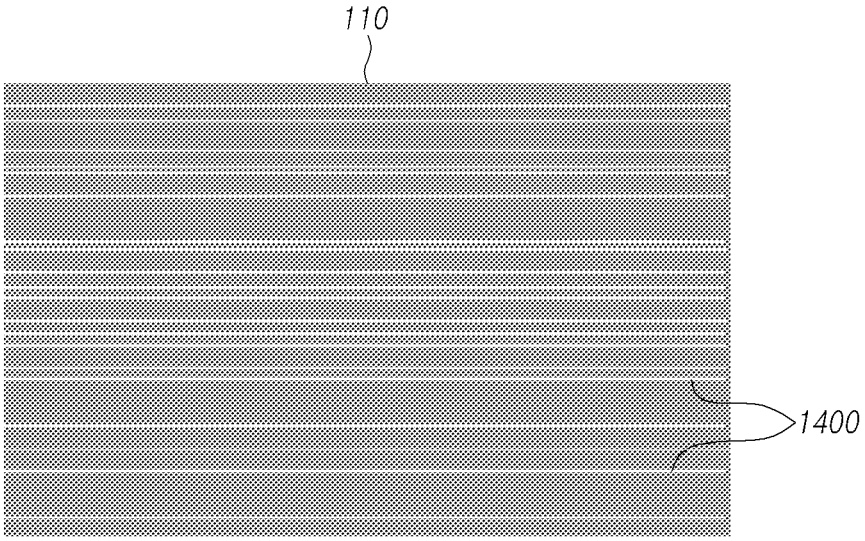
FIG. 14 illustrates a screen of the organic light-emitting display device according to one or more embodiments of the present disclosure, in which a degradation in image quality is caused by the fake data insertion driving performed during the real-time sensing driving.

As illustrated in FIG. 13, in all of the three cases, if the voltage condition of the data line DL is changed by the fake data insertion driving, the voltage condition of the reference voltage line RVL is changed also.

The fake data insertion driving performed during the real-time sensing creates an unintended voltage change in the reference voltage line RVL in the tracking step S620 of the real-time sensing, so that a voltage value of the reference voltage line RVL, detected in the sampling step S630, has an error. Such a sensing error leads to an erroneous compensation process.

Accordingly, in next video driving, an abnormal image may occur, e.g., subpixel rows having a real-time sensing error may appear as abnormal horizontal stripes 1400.

Hereinafter, the sensing target subpixel, on which the real-time sensing is performed, will be regarded as the subpixel SP21 located in the second subpixel row SPR #j illustrated in FIG. 12.

As described above, the sensing target subpixel SP21, on which the real-time sensing is performed, may include: the OLED; the driving transistor DRT driving the OLED; the scanning transistor T1 controlled by the scanning signal SCAN and electrically connected between the first node N1 of the driving transistor DRT and the first data line DL1; the sensing transistor T2 controlled by the sensing signal SENSE and electrically connected between the second node N2 of the driving transistor DRT and the first reference voltage line RVL; and the storage capacitor Cst electrically connected between the first node N1 and the second node N2 of the driving transistor DRT.

The first reference voltage line RVL, electrically connected to the sensing target subpixel SP21, may be electrically connected to one or more other subpixels SP, in addition to the sensing target subpixel SP1.

The organic light-emitting display device 100 may include the sensing reference switch SPRE controlling the connection between the sensing reference voltage supply node Npres and the first reference voltage line RVL; the analog-to-digital converter ADC detecting the voltage of the first reference voltage line RVL; and the sampling switch SAM controlling the connection between the first reference voltage line RVL and the analog-to-digital converter ADC.

Figure 15:
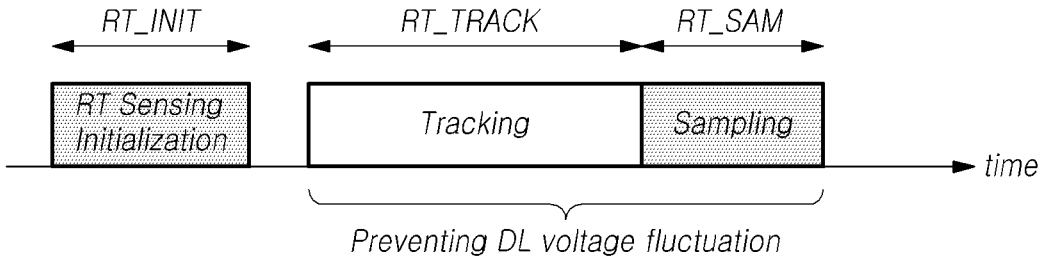
FIG. 15 illustrates a driving method for preventing degradations in image quality in the organic light-emitting display device according to one or more embodiments of the present disclosure, even in the case that the fake data insertion driving is performed during the real-time sensing driving.

FIG. 15 illustrates a driving method for preventing degradations in image quality in the organic light-emitting display device 100 according to one or more embodiments even in the case that the fake data insertion driving is performed during the real-time sensing driving.

Referring to FIG. 15, the sensing period for the sensing target subpixel SP21 selected from the plurality of subpixels SP for the real-time sensing may include a first period RT_INIT, a second period RT_TRACK, and a third period RT_SAM. In the first period RT_INIT, the sensing data voltage Vdata_SEN is supplied to the sensing target subpixel SP21 through the first data line DL1 among the plurality of data lines DL, and the sensing reference voltage VpreS is supplied to the sensing target subpixel SP21 through the first reference voltage line RVL, among the plurality of reference voltage lines RVL, corresponding to the sensing target subpixel SP21. In the second period RT_TRACK, the voltage of the first reference voltage line RVL is increased. In the third period RT_SAM, the voltage of the first reference voltage line RVL is detected when a predetermined time has passed after the start of the second period RT_TRACK.

In a case in which the RT sensing is the mobility sensing, the first period RT_INIT, the second period RT_TRACK, and the third period RT_SAM may correspond to the initialization step S610, the tracking step S62, and the sampling step S630 illustrated in FIG. 6, respectively.

In a case in which the real-time sensing is the threshold voltage sensing, the first period RT_INIT, the second period RT_TRACK, and the third period RT_SAM may correspond to the initialization step S510, the tracking step S520, and the sampling step S530 illustrated in FIG. 5, respectively.

Referring to FIG. 15, even in the case that the fake data insertion driving is performed during the real-time sensing driving, during the second period RT_TRACK and the third period RT_SAM after the first period RT_INIT, the organic light-emitting display device 100 may control the voltage of the data line DL crossing the connecting line CL so that the voltage of the connecting line CL and the data line DL electromagnetically interact with the first reference voltage line RVL, in order to prevent degradations in image quality.

Accordingly, regarding the arrangement of the lines, even in the case that the first reference voltage line RVL or the connecting line CL electromagnetically interact with the first reference voltage line RVL crosses the data line DL, there is no voltage change in the data line DL. Consequently, no voltage change is induced in the first reference voltage line RVL.

Accordingly, even in the case that the fake data insertion driving is performed during the real-time sensing driving, no real-time sensing error may occur.

Figure 16:
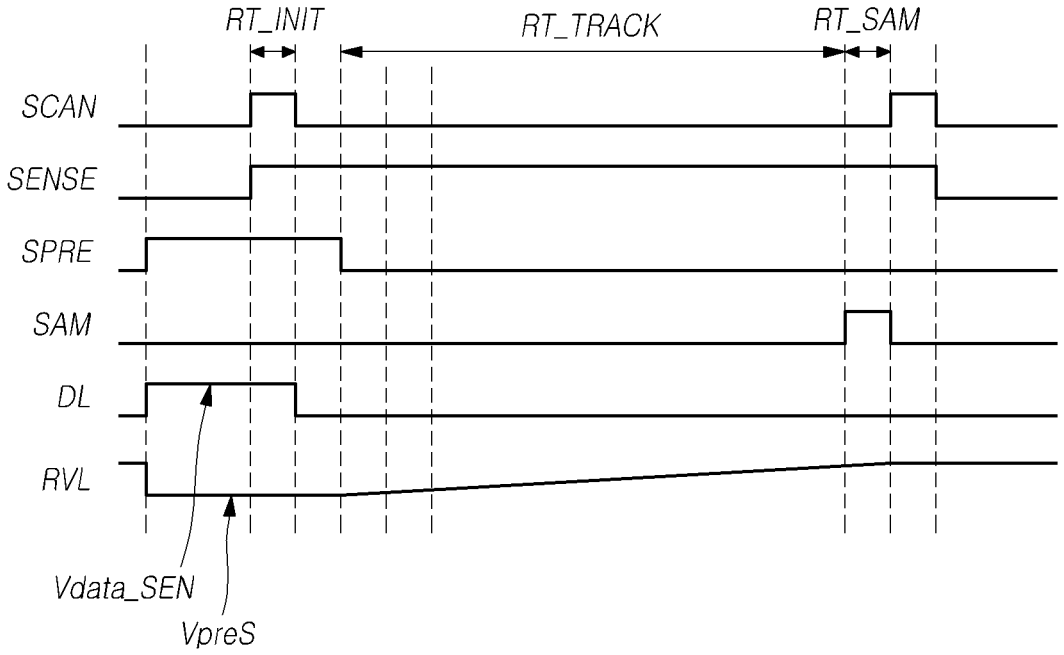
FIG. 16 illustrates a driving timing diagram in the organic light-emitting display device according to one or more embodiments of the present disclosure, the driving timing being designed to prevent degradations in image quality even in the case that the fake data insertion driving is performed during the real-time sensing driving.

FIG. 16 illustrates a driving timing diagram in the organic light-emitting display device 100 according to one or more embodiments, the driving timing being designed to prevent degradations in image quality even in the case that the fake data insertion driving is performed during the real-time sensing driving.

Referring to FIG. 16, during the first period RT_INIT in the sensing period for the sensing target subpixel SP21, the scanning signal SCAN is a turn-on level voltage, the sensing signal SENSE is a turn-on level voltage, the sensing reference switch SPRE is in a turned-on state, and the sampling switch SAM is in a turned-off state.

The scanning transistor T1 is turned on by the turn-on level voltage of the scanning signal SCAN, so that the sensing data voltage Vdata_SEN, supplied to the first data line DL1, is applied to the first node N1 of the driving transistor DRT in the sensing target subpixel SP21.

The sensing transistor T2 is turned on by the turn-on level voltage of the sensing signal SENSE, and the sensing reference voltage VpreS is applied to the first reference voltage line RVL in response to the sensing reference switch SPRE being in the turned-on state. Consequently, the sensing reference voltage VpreS can be applied to the second node N2 of the driving transistor DRT.

During the second period RT_TRACK, the scanning signal SCAN may be a turn-off level voltage, the sensing signal SENSE may be a turn-on level voltage, the sensing reference switch SPRE may be in a turned-off state, and the sampling switch SAM may be in a turned-off state.

The scanning transistor T1 is turned off by the turn-off level voltage of the scanning signal SCAN, so that the first node N1 of the driving transistor DRT is electrically floated.

The second node N2 of the driving transistor DRT is electrically floated in response to the sensing reference switch SPRE being in the turned-off state. Consequently, the voltage of the first reference voltage line RVL is increased from the sensing reference voltage VpreS.

During the third period RT_SAM, the scanning signal SCAN may be a turn-off level voltage, the sensing signal SENSE may be a turn-on level voltage, the sensing reference switch SPRE may be in a turned-off state, and the sampling switch SAM may be in a turned-on state.

In response to the turned-on state of the sampling switch SAM, the analog-to-digital converter ADC is electrically connected to the first reference voltage line RVL. The analog-to-digital converter ADC may detect the voltage of the first reference voltage line RVL increased during the second period RT_TRACK.

Referring to FIG. 16, even in the case that the fake data insertion driving is performed during the real-time sensing driving, during the second period RT_TRACK and the third period RT_SAM, the data line DL, crossing the first reference voltage line RVL or the connecting line CL electromagnetically interact with the first reference voltage line RVL, may maintain a voltage different from the sensing data voltage Vdata_SEN without a change in order to prevent degradations in image quality.

Referring to FIG. 16, during the second period RT_TRACK and the third period RT_SAM, the data line DL, crossing the first reference voltage line RVL or the connecting line CL electromagnetically interact with the first reference voltage line RVL, may maintain a specific voltage lower than the sensing data voltage Vdata_SEN.

In addition, in a case in which the fake driving is performed during the sensing period (e.g., real-time sensing period) for the sensing target subpixel SP21, during the second period RT_TRACK and the third period RT_SAM, the data line DL, crossing the first reference voltage line RVL or the connecting line CL electromagnetically interact with the first reference voltage line RVL, may maintain a fake data voltage different from the sensing data voltage Vdata_SEN and different from a data voltage generated from real video frame data.

For example, the fake data voltage may be a black data voltage.

A subpixel to which the fake data voltage is supplied (e.g., a subpixel on which the FDI driving is performed) may be a subpixel different from the sensing target subpixel SP21 to which the sensing data voltage Vdata_SEN is supplied.

The subpixel to which the fake data voltage is supplied (e.g., the subpixel on which the FDI driving is performed) may be located in a different line (e.g., a different subpixel row) from the sensing target subpixel SP21 to which the sensing data voltage Vdata_SEN is supplied.

The subpixel to which the fake data voltage is supplied (e.g., the subpixel on which the FDI driving is performed) and the sensing target subpixel SP21 to which the sensing data voltage Vdata_SEN is supplied may be commonly connected to a single first reference voltage line RVL.

The data line DL crossing the first reference voltage line RVL or the connecting line CL may be the same as the first data line DL1 corresponding to the sensing target subpixel SP21.

In some cases, the data line DL crossing the first reference voltage line RVL or the connecting line CL may be different from the first data line DL1 corresponding to the sensing target subpixel SP21.

The sensing period for the sensing target subpixel SP21 may be the real-time (RT) sensing period performed in the blank period.

The sensing period for the sensing target subpixel SP21 may be, for example, a sensing period in which the threshold voltage of the driving transistor DRT is detected or a sensing period in which the mobility of the driving transistor DRT is detected. For the sake of brevity, in FIGS. 16 to 19, the driving timing diagrams, regarding the sensing period in which the mobility of the driving transistor DRT is sensed, have been illustrated by way of example.

Referring to FIG. 16, the voltage of the first reference voltage line RVL is increased during the second period RT_TRACK in the sensing period.

A voltage increase rate, at which the voltage of the first reference voltage line RVL increases during the sensing period, is a voltage change over time $\Delta V/\Delta t$ of the reference voltage line RVL during the second period RT_TRACK. The voltage increase rate may correspond to the slope of the voltage change curve of the first reference voltage line RVL during the second period RT_TRACK in FIG. 16.

The voltage increase rate of the first reference voltage line RVL during the sensing period may be proportional to the mobility of the driving transistor DRT included in the sensing target subpixel SP21.

Therefore, as the mobility compensation process is performed as described above, when the video driving is performed on the sensing target subpixel SP21 later, depending on the voltage increase rate of the first reference voltage line RVL during the sensing period, the video driving data voltage to be supplied may be changed.

In addition, according to the driving method for preventing a voltage change in the data line DL, crossing the first reference voltage line RVL or the connecting line CL electromagnetically interact with the first reference voltage line RVL, during the second period RT_TRACK and third period RT_SAM, the real-time sensing is not influenced by the fake data insertion driving, even in the case that the fake data insertion driving is performed during the real-time sensing driving. Thus, the analog-to-digital converter ADC can obtain a sensing value without a sensing error, so that the compensator COMP can determine an accurate compensation value, on the basis of the accurate sensing value. Then, in the case of later video driving for the sensing target subpixel SP21, the controller 140 can generate video driving data using the accurate compensation value and provide the video driving data to the data driver circuit 120. Accordingly, an abnormal image, such as the horizontal stripes 1400, as illustrated in FIG. 14, can be prevented from occurring.

Hereinafter, the driver circuit 111, by which the driving method for preventing the real-time sensing from being influenced by the fake data insertion driving even in the case that the fake data insertion driving is performed during the real-time sensing driving (e.g., the method for preventing the fake data insertion (FDI)-induced real-time sensing error) is executed, will be described briefly.

Referring to FIG. 4, the data driver circuit 120 of the driver circuit 111 according to one or more embodiments may include the data voltage output circuit 400, the analog-to-digital converter ADC, and the like.

The data voltage output circuit 400 may supply the sensing data voltage Vdata_SEN to the sensing target subpixel SP21, selected from among the plurality of subpixels SP, through the first data line DL1.

The analog-to-digital converter ADC may detect the voltage of the first reference voltage line RVL when a predetermined time has passed after the voltage of first reference voltage line RVL, electrically connected to the sensing target subpixel SP21 among the plurality of reference voltage lines RVL, started to increase.

After the start of the voltage increase in the first reference voltage line RVL and before the completion of the voltage sensing in the first reference voltage line RVL, the data voltage output circuit 400 may supply a voltage, different from the sensing data voltage Vdata_SEN, to the data line DL crossing the first reference voltage line RVL or the connecting line CL electromagnetically interact with the first reference voltage line RVL.

After the start of the voltage increase in the first reference voltage line RVL and before the completion of the voltage sensing in the first reference voltage line RVL, the data voltage output circuit 400 may supply a specific voltage, lower than the sensing data voltage Vdata_SEN, to the data line DL crossing the first reference voltage line RVL or the connecting line CL.

Referring to FIG. 4, the data driver circuit 120 of the driver circuit 111 according to one or more embodiments may further include: the sensing reference switch SPRE controlling the connection between the sensing reference voltage supply node Npres and the first reference voltage line RVL; and the sampling switch SAM controlling the connection between the first reference voltage line RVL and the analog-to-digital converter ADC.

Figure 17:
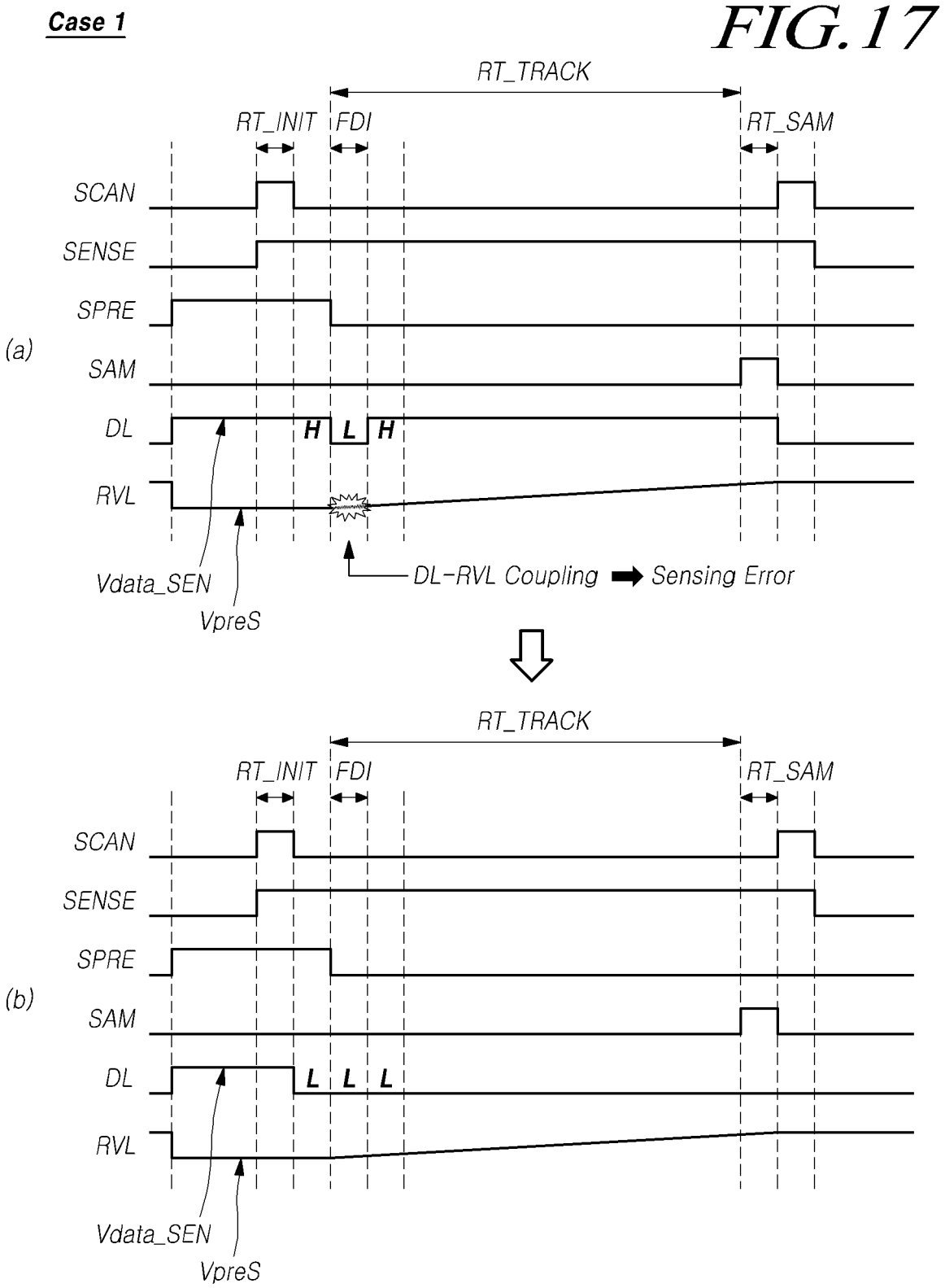
FIG. 17 is a driving timing diagram illustrating a first case of timing relationship between the real-time sensing driving and the fake data insertion driving in the organic light-emitting display device according to one or more embodiments of the present disclosure, in a case in which the fake data insertion driving is performed during the real-time sensing driving.
Figure 18:
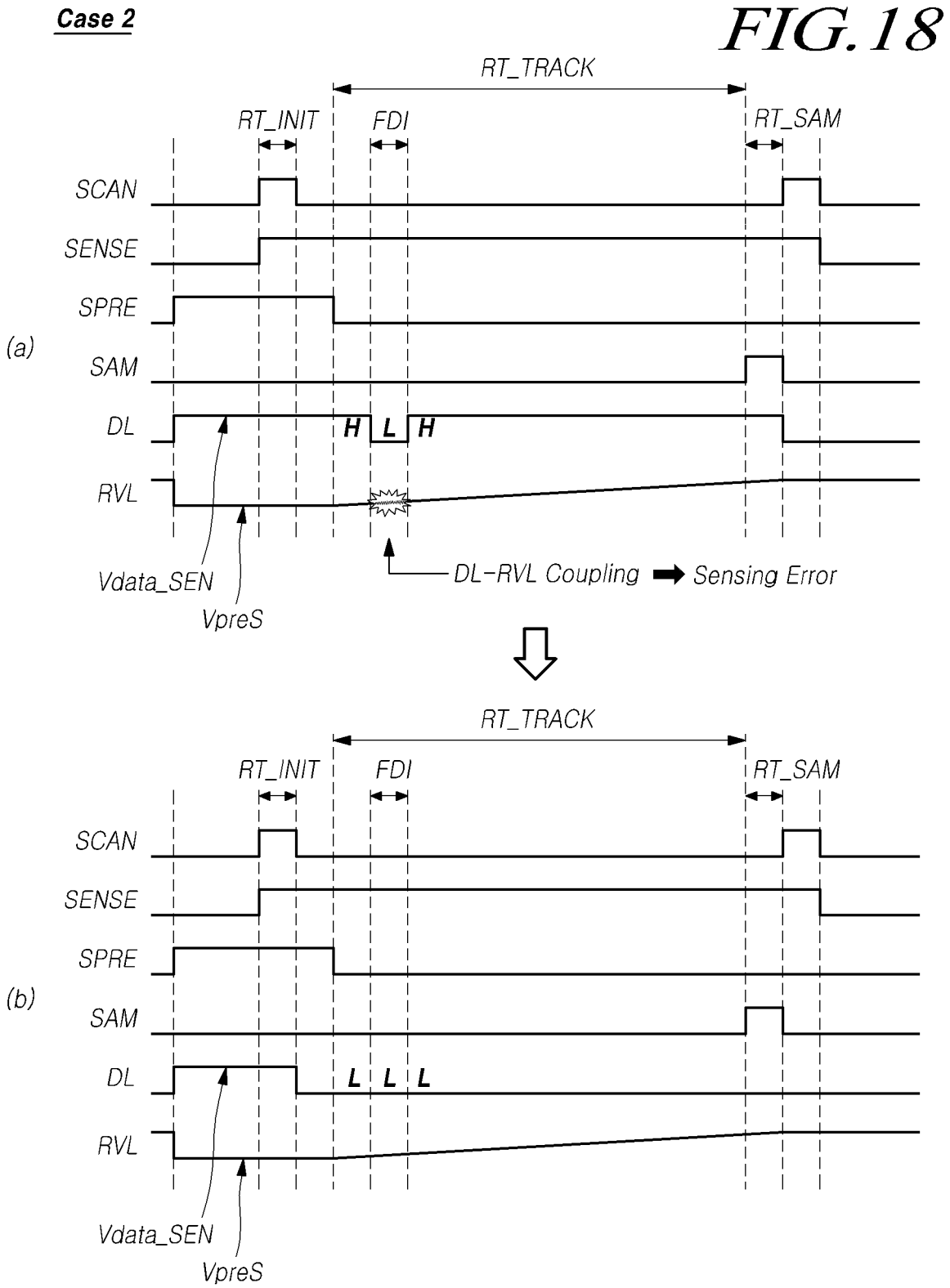
FIG. 18 is a driving timing diagram illustrating a second case of timing relationship between the real-time sensing driving and the fake data insertion driving in the organic light-emitting display device according to one or more embodiments of the present disclosure, in a case in which the fake data insertion driving is performed during the real-time sensing driving.
Figure 19:
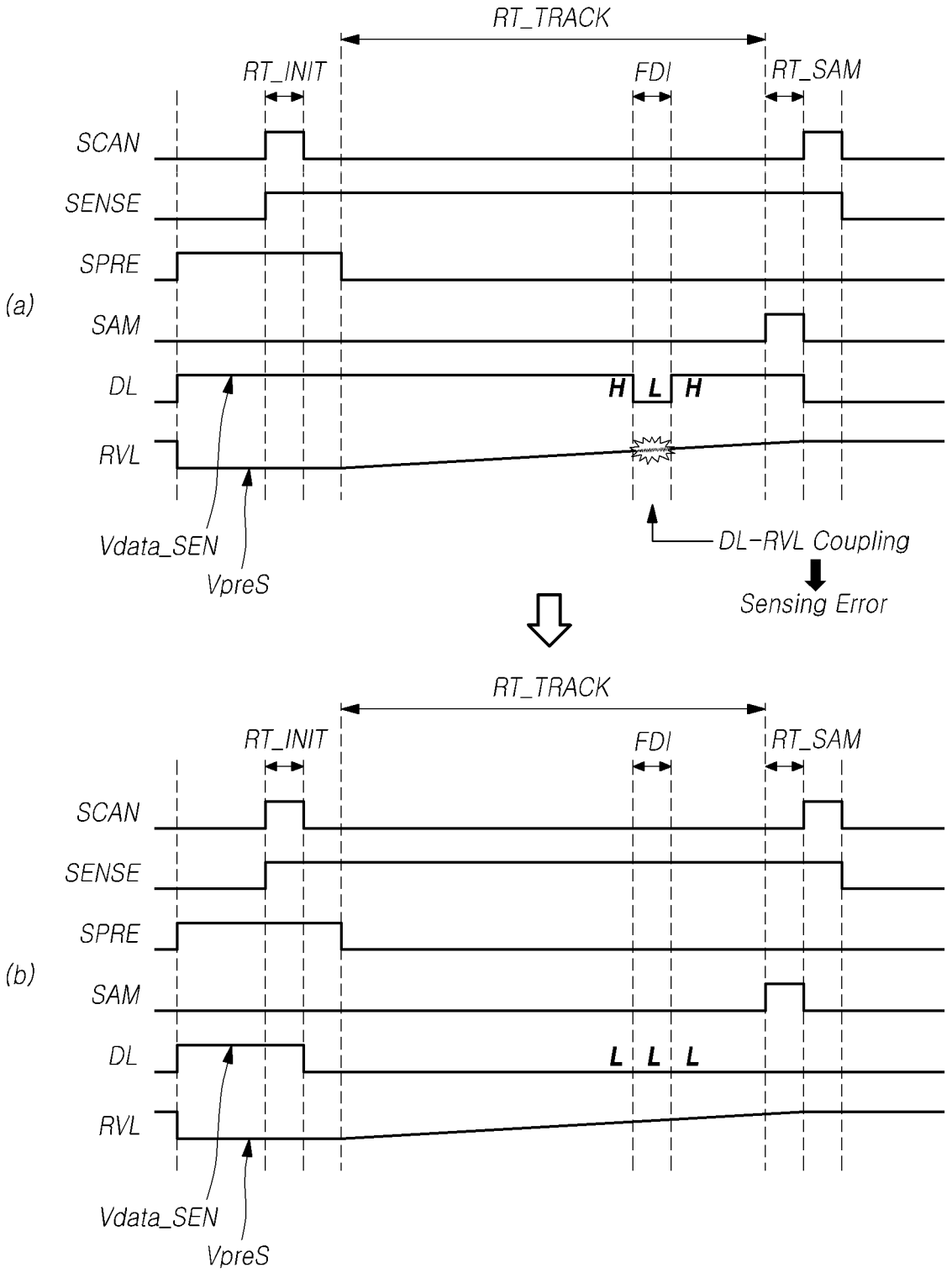
FIG. 19 is a driving timing diagram illustrating a third case of timing relationship between the real-time sensing driving and the fake data insertion driving in the organic light-emitting display device according to one or more embodiments of the present disclosure, in a case in which the fake data insertion driving is performed during the real-time sensing driving.
Figure 20:
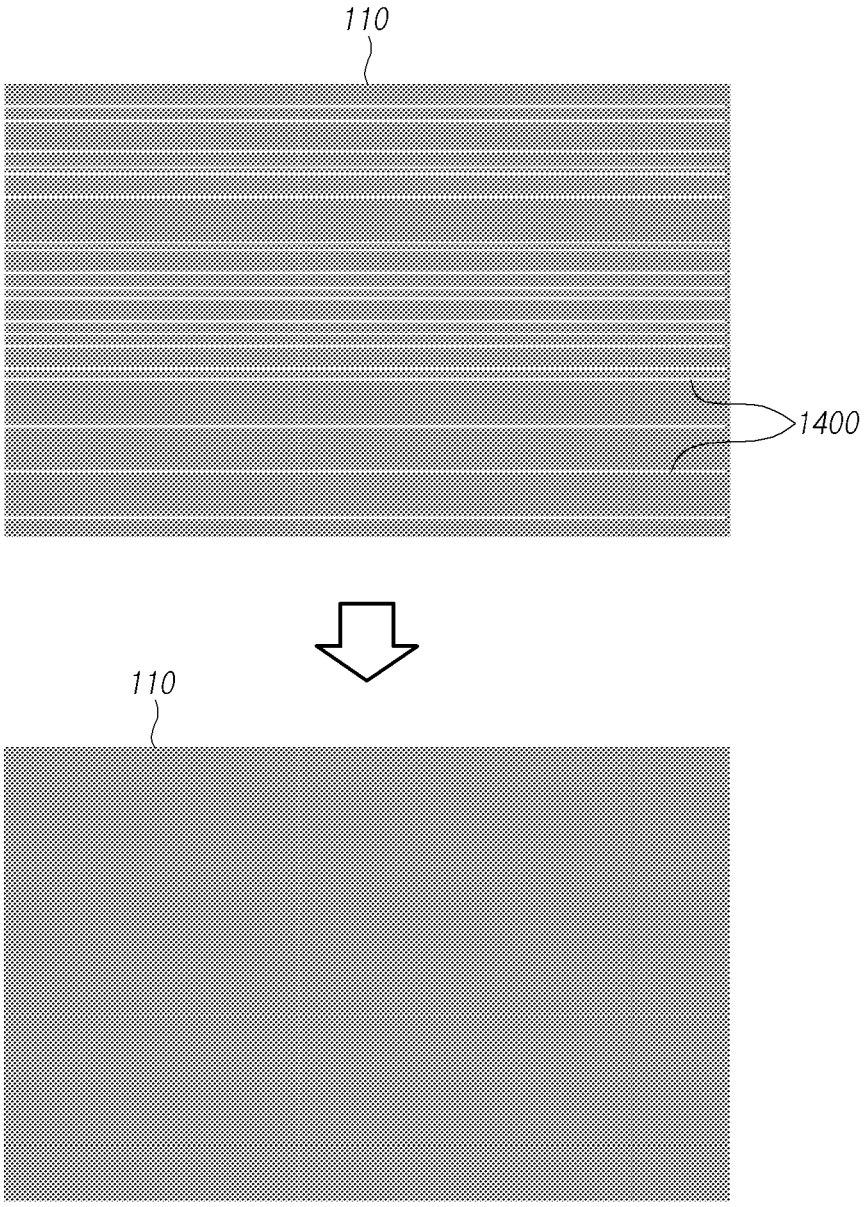
FIG. 20 illustrates a screen of the organic light-emitting display device according to one or more embodiments of the present disclosure, in which degradations in image quality are prevented even in the case that the fake data insertion driving is performed during the real-time sensing driving.

FIGS. 17 to 19 are driving timing diagrams illustrating three cases (Cases 1, 2, and 3) of timing relationship between the real-time sensing driving and the fake data insertion driving in the organic light-emitting display device 100 according to one or more embodiments, in a case in which the fake data insertion driving is performed during the real-time sensing driving. FIG. 20 illustrates a screen of the organic light-emitting display device 100 according to one or more embodiments, in which degradations in image quality are prevented even in the case that the fake data insertion driving is performed during the real-time sensing driving.

In FIGS. 17 to 19, (a) depicts the driving timing diagram in a case in which the FDI-induced real-time sensing error preventing method is not used, and (b) depicts the driving timing diagram in a case in which the FDI-induced real-time sensing error preventing method is used.

Referring to (a) in FIGS. 17 to 19, since the FDI-induced real-time sensing error preventing method is not used, the data line DL may have a voltage change in the real-time sensing driving, along with the fake data insertion driving being performed during the second period RT_TRACK after the first period RT_INIT.

That is, the voltage of the data line DL may be changed from a high-level voltage H, corresponding to the sensing data voltage Vdata_SEN, to a low-level voltage L, corresponding to the fake data voltage, and then to the high-level voltage H, corresponding to the sensing data voltage Vdata_SEN.

Such voltage changes (H→L→H; from a logic high signal to a logic low signal and then to a logic high signal) in the data line may induce a voltage change in the first reference voltage line RVL, due to DL-RVL electromagnetic interaction that can be generated due to the line array structure. Consequently, during the second period RT_TRACK, in a portion of the periods corresponding to the cases, the voltage increase for the sensing is abnormal.

Accordingly, the voltage of the first reference voltage line RVL, detected in the third period RT_SAM, may have an error. That is, such a sensing error may lead to a compensation error which in turn generates an abnormal image, such as the horizontal stripes 1400 across the display as shown in FIG. 14 or 20.

However, when the FDI-induced real-time sensing error preventing method is used, as depicted in (b) of FIGS. 17 to 19, voltage changes in the data line DL can be prevented during the real-time sensing driving even in the case that the fake data insertion driving is performed at a point in time during the second period RT_TRACK after the first period RT_INIT.

For example, as depicted in (b) of FIGS. 17 to 19, during the real-time sensing driving, the low-level voltage L, corresponding to the fake data voltage, may be previously applied to the data line DL before the fake data insertion driving after the first period RT_INIT, thereby preventing voltage changes in the data line DL.

That is, the low-level voltage L, corresponding to the fake data voltage, may be previously applied to the data line DL before the proceeding of the fake data insertion driving at the high-level voltage H sensing data voltage Vdata_SEN. The previously-applied low-level voltage L may be maintained before and after the FDI driving period.

The effect of the changes in the voltage levels of the data line DL are removed or made insignificant by maintaining the low voltage level (L→L→L) of the data line DL. Further, by doing so, the effect of the DL-RVL electromagnetic interaction (e.g., electromagnetic coupling, interferences, or the like) generated due to the line array structure becomes moot and no voltage change can be experienced at the first reference voltage line RVL. Consequently, the voltage increase in the first reference voltage line RVL for the sensing may be carried out normally during the second period RT_TRACK.

Accordingly, in the third period RT_SAM, the sensing voltage of the first reference voltage line RVL has no error. Therefore, an accurate sensing value can be obtained, and an accurate compensation value can be determined, thereby preventing an abnormal image, such as the horizontal stripes 1400, as illustrated in FIG. 20.

Hereinafter, the above-described driving method for preventing FDI-induced real-time sensing errors according to one or more embodiments will be briefly described again.

Figure 21:
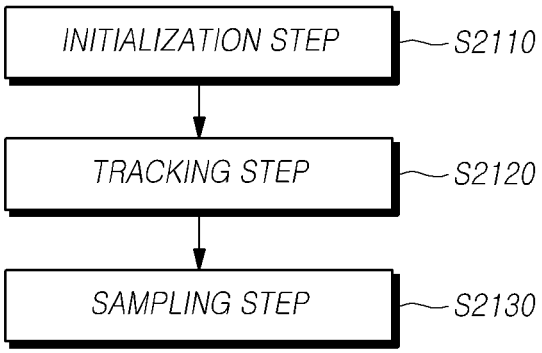
FIG. 21 is a flowchart illustrating a driving method of the organic light-emitting display device according to one or more embodiments of the present disclosure.

FIG. 21 is a flowchart illustrating the driving method of the organic light-emitting display device 100 according to one or more embodiments.

Referring to FIG. 21, the driving method of the organic light-emitting display device 100 according to one or more embodiments may include: a first step S2110 (RT_INIT) of supplying the sensing data voltage Vdata_SEN to the sensing target subpixel SP21 through the first data line DL1 among the plurality of data lines DL, and supplying the sensing reference voltage VpreS to the sensing target subpixel SP21 through the first reference voltage line RVL among the plurality of reference voltage lines RVL; a second step S2120 (RT_TRACK) of increasing the voltage of the first reference voltage line RVL; and a third step S2130

(RT_SAM) detecting the voltage of the first reference voltage line RVL when a predetermined time has passed after the start of the second step S2120.

During the second step S2120 and the third step S2310, the data line DL crossing the first reference voltage line RVL or the connecting line CL electromagnetically interact with the first reference voltage line RVL may be maintained at a voltage different from the sensing data voltage Vdata_SEN.

During the second step S2120 and the third step S2310, the data line DL crossing the first reference voltage line RVL or the connecting line CL may be maintained at a voltage lower than the sensing data voltage Vdata_SEN.

During the second step S2120 and the third step S2310, the data line DL crossing the first reference voltage line RVL or the connecting line CL may be maintained at a fake data voltage different from the sensing data voltage Vdata_SEN and different from a data voltage generated from real video frame data.

For example, the fake data voltage may be a black data voltage.

The sensing period for the sensing target subpixel SP21 may be a real-time (RT) sensing period performed in the blank period.

As set forth above, according to one or more embodiments, it is possible to accurately detect luminance deviations among the subpixels without a sensing error, thereby accurately compensating for the luminance deviations among the subpixels. Consequently, image quality can be improved.

According to one or more embodiments, it is possible to accurately perform the sensing driving in real time during the video driving. Consequently, efficient sensing is possible, and image quality can be improved.

According to one or more embodiments, even in the case that other video control driving for the improvement of image quality is performed during the sensing, a sensing error can be prevented from being caused by the other video control driving, so that an accurate sensing result can be obtained.

According to one or more embodiments, even in the case that fake image driving (e.g., black data insertion driving) corresponding to the other video control driving for the improvement of image quality is performed during the sensing, a sensing error can be prevented from being caused by the fake image driving, so that an accurate sensing result can be obtained.

According to one or more embodiments, even in the case that the fake image driving (e.g., black data insertion driving) is performed during the sensing, the reference voltage line used as a sensing line can be prevented from voltage changes by the fake image driving (e.g., black data insertion driving), so that an accurate sensing result can be obtained.

The foregoing descriptions and the accompanying drawings have been presented in order to explain certain principles of the present disclosure by way of example. A person having ordinary skill in the art to which the present disclosure relates could make various modifications and variations by combining, dividing, substituting for, or changing the elements without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended Claims and all of their equivalents fall within the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A light-emitting display device comprising:

a display panel having a plurality of subpixels, a plurality of data lines, a plurality of gate lines, a plurality of reference voltage lines, and a plurality of connecting lines connected to the plurality of reference voltage lines, respectively;

a data driver circuit driving the plurality of data lines; and a gate driver circuit driving the plurality of gate lines, wherein each of the plurality of subpixels is either directly connected to a respective reference voltage line or connected to a respective reference voltage line through a respective connecting line, and the plurality of connecting lines are disposed to cross the plurality of data lines, wherein the plurality of data lines includes a first data line, and the plurality of reference voltage lines includes a first reference voltage line, and the plurality of connecting lines includes a first connecting line, wherein a sensing period for a sensing target subpixel selected from among the plurality of subpixels includes:

a first period in which a sensing data voltage is supplied to the sensing target subpixel through the first data line, and a sensing reference voltage is supplied to the sensing target subpixel through either the first reference voltage line or the first connecting line connected to the first reference voltage line;

a second period in which a voltage of the first reference voltage line is increased; and a third period in which a voltage of the first reference voltage line is detected when a predetermined time has passed after a start of the second period, wherein, during the first period, the first data line is supplied with the sensing data voltage, during the second period and the third period, the first data line is maintained at a voltage different from the sensing data voltage, and the first data line crosses the first connecting line that is electrically connected to the first reference voltage line.

2. The light-emitting display device according to claim 1, wherein, during the second period and the third period, the first data line crossing the first connecting line is maintained at a voltage lower than the sensing data voltage.

3. The light-emitting display device according to claim 1, wherein, during the second period and the third period, the first data line crossing the first connecting line is maintained at a fake data voltage different from the sensing data voltage and different from a data voltage generated from real video frame data.

4. The light-emitting display device according to claim 3, wherein the fake data voltage is a black data voltage.

5. The light-emitting display device according to claim 3, wherein a subpixel, among the plurality of subpixels, to which the fake data voltage is supplied, is different from the sensing target subpixel, and is located on a different line from the sensing target subpixel, the subpixel to which the fake data voltage is supplied and the sensing target subpixel being commonly connected to the first reference voltage line.

6. The light-emitting display device according to claim 1, wherein the first data line crossing the first connecting line is the same as the first data line that the sensing data voltage is supplied to the sensing target subpixel.

7. The light-emitting display device according to claim 1, wherein the sensing target subpixel comprises:

an organic light-emitting diode;

a driving transistor electrically connected to and configured to drive the organic light-emitting diode, the driving transistor having a first node, a second node;

a scanning transistor controlled by a scanning signal, and electrically connected between the first node of the driving transistor and the first data line;

a sensing transistor controlled by a sensing signal, and electrically connected between the second node of the driving transistor and the first reference voltage line or between the second node of the driving transistor and the first connecting line connected to the first reference voltage line; and a storage capacitor electrically connected between the first node and the second node of the driving transistor, wherein the first reference voltage line is electrically connected to one or more subpixels other than the sensing target subpixel, the light-emitting display device further comprising:

a sensing reference switch controlling a connection between a sensing reference voltage supply node and the first reference voltage line;

an analog-to-digital converter sensing a voltage of the first reference voltage line; and a sampling switch controlling a connection between the first reference voltage line and the analog-to-digital converter.

8. The light-emitting display device according to claim 7, wherein:

during the first period, the scanning signal is a turn-on level voltage, the sensing signal is a turn-on level voltage, the sensing reference switch is in a turned-on state, and the sampling switch is in a turned-off state;

during the second period, the scanning signal is a turn-off level voltage, the sensing signal is the turn-on level voltage, the sensing reference switch is in a turned-off state, and the sampling switch is in the turned-off state; and during the third period, the scanning signal is the turn-off level voltage, the sensing signal is the turn-on level voltage, the sensing reference switch is in the turned-off state, and the sampling switch is in the turned-on state.

9. The light-emitting display device according to claim 1, wherein the sensing period for the sensing target subpixel is a real-time sensing period performed in a blank period during display driving.

10. The light-emitting display device according to claim 1, wherein a video driving data voltage to be supplied to the sensing target subpixel is changed depending on an amount or a rate by which a voltage of the first reference voltage line increases during the sensing period.

11. The light-emitting display device according to claim 10, wherein a rate, by which a voltage of the first reference voltage line increases, is proportional to mobility of a driving transistor in the sensing target subpixel.

12. A driving method of a light-emitting display device having a plurality of subpixels, a plurality of data lines, a plurality of gate lines, a plurality of reference voltage lines, and a plurality of connecting lines, the driving method comprising:

supplying a sensing data voltage to a sensing target subpixel among the plurality of subpixels through a data line among the plurality of data lines;

supplying a sensing reference voltage to the sensing target subpixel through a first reference voltage line among the plurality of reference voltage lines or a first connecting line connected to the first reference voltage line among the plurality of connecting lines;

increasing a voltage of the first reference voltage line;

detecting the voltage of the first reference voltage line when a predetermined time has passed after a start of the increasing of the voltage of the first reference voltage line; and during a period between the increase of the voltage of the first reference voltage line and the detection of a voltage of the first reference voltage line, maintaining a voltage of the first data line at a voltage different from the sensing data voltage, and wherein the first data line crosses the first connecting line that is electrically connected to the first reference voltage line.

13. The driving method according to claim 12, further comprising:

during the increase of the voltage of the first reference voltage line and the detection of the voltage of the first reference voltage line, maintaining a voltage of the first data line crossing the first connecting line at a voltage lower than the sensing data voltage.

14. The driving method according to claim 12, further comprising:

during the increase of the voltage of the first reference voltage line and the detection of the voltage of the first reference voltage line, maintaining a voltage of the first data line crossing the first connecting line at a fake data voltage different from the sensing data voltage and different from a data voltage generated from real video frame data.

15. The driving method according to claim 14, wherein the fake data voltage is a black data voltage.

16. The driving method according to claim 12, wherein a sensing period for the sensing target subpixel is a real-time sensing period performed in a blank period during display driving.

17. A driver circuit of a light-emitting display device including a display panel having a plurality of data lines, a plurality of gate lines, a plurality of subpixels, a plurality of reference voltage lines, and a plurality of connecting lines connected to the plurality of reference voltage lines, respectively, the driver circuit comprising:

a data voltage output circuit supplying a sensing data voltage to a sensing target subpixel selected from among the plurality of subpixels, through a first data line among the plurality of data lines; and an analog-to-digital converter detecting a voltage of a first reference voltage line electrically connected to the sensing target subpixel among the plurality of reference voltage lines when a predetermined time has passed after a voltage of the first reference voltage line started to increase, wherein the plurality of connecting lines includes a first connecting line, wherein, after a voltage of the first reference voltage line started to increase and before completion of the detection of a voltage of the first reference voltage line, the data voltage output circuit supplies a voltage different from the sensing data voltage to the first data line, and the first data line crosses the first connecting line that is electrically connected to the first reference voltage line.

18. The driver circuit according to claim 17, wherein, after a voltage of the first reference voltage line started to increase and before completion of the detection of a voltage of the first reference voltage line, the data voltage output circuit supplies a voltage lower than the sensing data voltage to the first data line crossing the first connecting line.

19. The driver circuit according to claim 17, further comprising:

a sensing reference switch controlling a connection between a sensing reference voltage supply node and the first reference voltage line; and a sampling switch controlling a connection between the first reference voltage line and the analog-to-digital converter.

20. The driver circuit according to claim 17, wherein a rate by which a voltage of the first reference voltage line increases, is proportional to mobility of a driving transistor in the sensing target subpixel.

* * * * *